US011293663B2

(12) United States Patent
Schmidt et al.

(10) Patent No.: US 11,293,663 B2
(45) Date of Patent: Apr. 5, 2022

(54) FABRIC DROP-DOWN DIFFUSERS

(71) Applicant: Rite-Hite Holding Corporation, Milwaukee, WI (US)

(72) Inventors: Blaine Schmidt, Peosta, IA (US); Kevin J. Gebke, Dubuque, IA (US); Nicolas B. Paschke, Mequon, WI (US); Thomas C. Smith, Raleigh, NC (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 128 days.

(21) Appl. No.: 16/186,283

(22) Filed: Nov. 9, 2018

(65) Prior Publication Data

US 2019/0128557 A1 May 2, 2019

Related U.S. Application Data

(63) Continuation-in-part of application No. 15/417,006, filed on Jan. 26, 2017.

(51) Int. Cl.
*F24F 13/02* (2006.01)
*F24F 13/06* (2006.01)

(52) U.S. Cl.
CPC ..... *F24F 13/06* (2013.01); *F24F 13/0218* (2013.01); *F24F 2013/0608* (2013.01); *F24F 2221/14* (2013.01)

(58) Field of Classification Search
CPC ..... F24F 13/06; F24F 13/0218; F24F 2013/0608; F24F 2221/14; F24F 13/068;
(Continued)

(56) References Cited

U.S. PATENT DOCUMENTS 4,009,647 A 3/1977 Howorth
4,890,544 A * 1/1990 Aalto ..... F24F 9/00 454/49

(Continued)

FOREIGN PATENT DOCUMENTS

CN 101960201 1/2011
CN 103958981 7/2014

(Continued)

OTHER PUBLICATIONS

United States Patent and Trademark Office, "Restriction Requirement" issued in connection with U.S. Appl. No. 15/417,006 dated Oct. 25, 2019, (8 pages).

(Continued)

*Primary Examiner* — Edelmira Bosques
*Assistant Examiner* — Ryan L Faulkner
(74) *Attorney, Agent, or Firm* — Hanley, Flight & Zimmerman, LLC

(57) ABSTRACT

Fabric drop-down diffusers are disclosed. An example drop-down diffuser includes a first fabric sheet. The first fabric sheet is to extend away from a ceiling at a location adjacent a supply inlet. The supply inlet is to provide a flow of air toward the first fabric sheet. The example drop-down diffuser also includes a blanking sheet to restrict air flow through the first fabric sheet. The blanking sheet is to be disposed on an interior surface of the first fabric sheet. The blanking sheet has a lower permeability than the first fabric sheet.

21 Claims, 17 Drawing Sheets

(58) Field of Classification Search
CPC ..... F24F 2003/1435; F24F 13/084; F24F 13/062; F24F 13/082; F24F 11/30; F24F 11/52; F24F 11/523; F24F 11/49; E04B 2009/0492
USPC ..... 454/296, 160, 170
See application file for complete search history.

(56) References Cited

U.S. PATENT DOCUMENTS

| | | | | |
|---|---|---|---|---|
| 5,655,963 | A | 8/1997 | Paschke et al. | |
| 5,735,738 | A * | 4/1998 | Kuno | F24F 13/22 454/296 |
| 5,782,689 | A | 7/1998 | Woolsey et al. | |
| 6,558,250 | B1 * | 5/2003 | Paschke | F16L 55/02718 454/306 |
| 8,434,526 | B1 | 5/2013 | Pinkalla et al. | |
| 8,844,578 | B2 | 9/2014 | Pinkalla et al. | |
| 9,152,191 | B1 | 10/2015 | Gardner | |
| 9,605,864 | B2 | 3/2017 | Pinkalla et al. | |
| 9,605,865 | B2 | 3/2017 | Pinkalla et al. | |
| 9,612,033 | B2 | 4/2017 | Pinkalla et al. | |
| 2002/0155805 | A1 | 10/2002 | Paschke | |
| 2003/0022617 | A1 | 1/2003 | Gebke et al. | |
| 2008/0176506 | A1 * | 7/2008 | Gebke | F24F 13/0218 454/284 |
| 2009/0221226 | A1 * | 9/2009 | Gebke | F16L 11/02 454/297 |
| 2011/0269390 | A1 | 11/2011 | Pinkalla et al. | |
| 2012/0052792 | A1 * | 3/2012 | Sinur | F04D 27/001 454/341 |
| 2018/0058714 | A1 | 3/2018 | Prihoda et al. | |
| 2018/0209685 | A1 | 7/2018 | Schmidt et al. | |

FOREIGN PATENT DOCUMENTS

| | | |
|---|---|---|
| CN | 204153934 | 2/2015 |
| DE | 102010026459 | 1/2012 |
| EP | 2578957 | 4/2013 |
| EP | 2896905 | 7/2015 |
| FR | 2713317 | 6/1995 |
| GB | 2120778 | 12/1983 |
| KR | 101425867 | 8/2014 |
| WO | 2016141901 | 9/2016 |
| WO | 2016187291 | 11/2016 |
| WO | 2018140317 | 8/2019 |

OTHER PUBLICATIONS

United States Patent and Trademark Office, "Non-Final Office Action", issued in connection with U.S. Appl. No. 15/417,006, dated Feb. 20, 2020, (34 pages).
International Searching Authority, "International Search Report and Written Opinion," issued in connection with International application No. PCT/US2018/014424, dated Jun. 18, 2018, 7 pages.
Canadian Intellectual Property Office, "Office Action," issued in connection with Canadian Patent Application No. 3,050,905, dated Dec. 21, 2020,4 pages.
Indian Intellectual Property Office, "Examination Report," issued in connection with Indian Patent Application No. 201917029494, dated Nov. 27, 2020, 6 pages.
International Searching Authority, "Search Report and Written Opinion of the International Searching Authority," issued in connection with PCT application No. PCT/US2019/059673, dated Mar. 26, 2020, (7 pages).
United States Patent and Trademark Office, "Final Office Action," issued in connection with U.S. Appl. No. 15/417,006, dated Oct. 7, 2020, (18 pages).
Japanese Patent Office, "Notice of Reasons for Rejection," issued in connection with Japanese patent application No. 2019-538646, dated Aug. 28, 2020, (8 pages).
Australian Government, "Examination report No. 1 for standard patent application" issued in connection with Australian patent application No. 2018212451, dated Dec. 6, 2019, (3 pages).
IP Australia, "Notice of Acceptance," issued in connection with Australian Patent Application No. 2018212451, dated Jul. 10, 2020, 3 pages.
China National Intellectual Property Administration, "First Office Action," issued in connection with Chinese Patent Application No. 201880007321.0, dated Jul. 2, 2020, 20 pages.
Prihoda sro, "Fabric ducting Lantern with membrane prihoda," Screenshots from Youtube video, <https://www.youtube.com/watch?v=T58xRuZIrSM>, Nov. 30, 2015, 3 pages.
Canadian Intellectual Property Office, "Examination Report," issued in connection with Canadian patent application No. 3,050,905, dated May 28, 2021, 4 pages.
The China National Intellectual Property Administration, "Notice of Completing Formalities for Patent Registration," issued on connection with Chinese Patent Application No. 201880007321.0, dated Jul. 13, 2021, 8 pages. (English Translation Attached).
International Searching Authority, "International Preliminary Report on Patentability and Written Opinion," issued on connection with PCT Patent Application No. PCT/US2019/059673, dated May 11, 2021, 6 pages.
European Patent Office, "Communication Pursuant to Rule 114(2) EPC," issued in connection with European patent application No. 18713398.8, dated Aug. 6, 2020, 25 pages.
Prihoda, "Air Diffuser Lantern," Apr. 15, 2016, 1 page.
Prihoda, "Tailor-made Air Ducting & Diffusers Air Diffuser Lantern," Apr. 15, 2016, 3 page.
United States Patent and Trademark Office, "Notice of Allowance and Fee(s) Due," issued in connection with U.S. Appl. No. 15/417,006, dated Sep. 15, 2021, 8 pages.
United States Patent and Trademark Office, "Advisory Action Before the Filing of an Appeal Brief," issued in connection with U.S. Appl. No. 15/417,006, dated Feb. 16, 2021, 3 pages.
European Patent Office, "Communication pursuant to Article 94(3) EPC,"' issued in connection with European Patent application No. 18713398.8, dated Dec. 22, 2020, 4 pages.
China National Intellectual Property Administration, "Search Report," issued in connection with Minese patent application No. 201880007321.0, dated Feb. 3, 2021, 23 pages.
Japanese Patent Office, "Notice of Allowance," issued in connection with Japanese patent application No. 2019-538646, dated Apr. 6, 2021, 5 pages. (English summary attached).
Canadian Patent Office, "Notice of Allowance," issued in connection with Canadian patent application No. 3,050,905, dated Jan. 13, 2022, 1 pages.

* cited by examiner

FABRIC DROP-DOWN DIFFUSERS

CROSS-REFERENCE TO RELATED APPLICATIONS

This patent arises from a continuation-in-part of U.S. patent application Ser. No. 15/417,006, entitled "Fabric Drop-Down Diffusers," filed on Jan. 26, 2017. Priority to U.S. patent application Ser. No. 15/417,006 is hereby claimed, and U.S. patent application Ser. No. 15/417,006 is hereby incorporated herein by reference in its entirety.

FIELD OF THE DISCLOSURE

This patent generally pertains to HVAC systems (heating ventilating and air-conditioning systems) and more specifically to fabric drop-down diffusers.

BACKGROUND

HVAC systems (heating ventilating and air-conditioning systems) typically include a blower that circulates conditioned air through one or more areas in a building. As used herein, the air entering the areas is referred to as, "supply air," and the leaving air is called, "return air." Some HVAC systems will heat, cool, dehumidify, humidify, filter and/or otherwise condition the air before one or more discharge outlets deliver the supply air to chosen areas of the building.

A drop-down diffuser is one example of such a discharge outlet. A drop-down diffuser usually comprises a rigid box-like structure mounted at an overhead location, usually near the ceiling of the building. A supply air duct typically feeds supply air down in through the top of the box-like structure, and peripheral openings in the diffuser release the supply air to the surrounding area.

Some drop-down diffusers have a sheet of porous fabric attached to the rigid box-like structure. The porous fabric helps in evenly dispersing the supply air into the areas being served by the HVAC system. One example of such a diffuser is disclosed in US Published Patent Application No. 2008/0176506 A1, which is specifically incorporated herein by reference in its entirety.

DETAILED DESCRIPTION

Example drop-down diffusers for HVAC systems (heating, ventilating and air conditioning systems) are comprised of non-porous and/or air-permeable fabric supported internally by one or more rigid hoops. In some examples, a drawstring tightens fabric panels over an upper and/or a lower hoop. In some examples, internal fabric baffles help direct airflow and muffle noise. Some example diffusers have various means for connecting to a sheet metal duct and various means for creating an internal conical air deflector. In some examples, the conical deflector is curved and its shape is adjustable.

Figure 1:
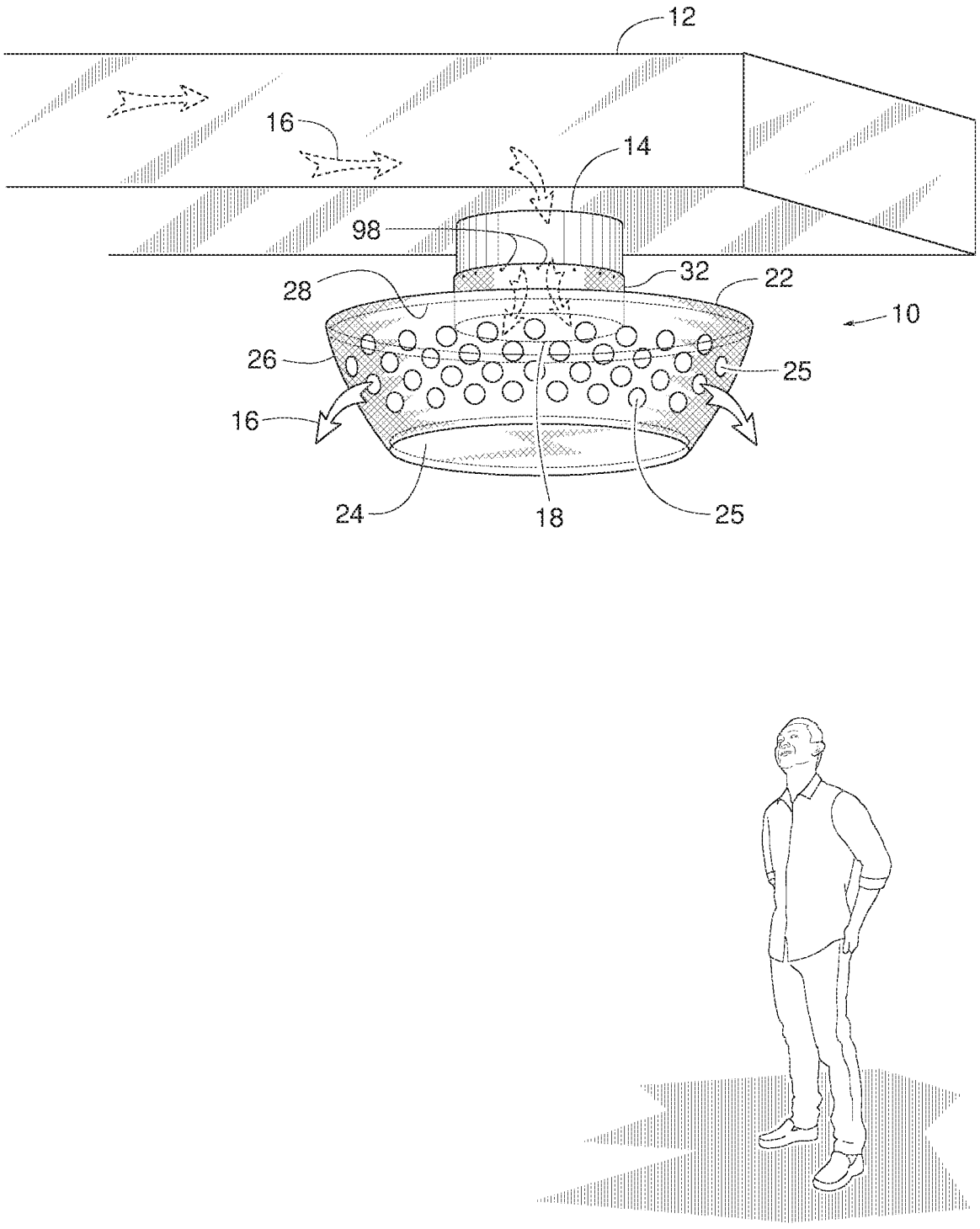
FIG. 1 is a perspective view of an example drop-down diffuser constructed in accordance with the teachings disclosed herein.
Figure 2:
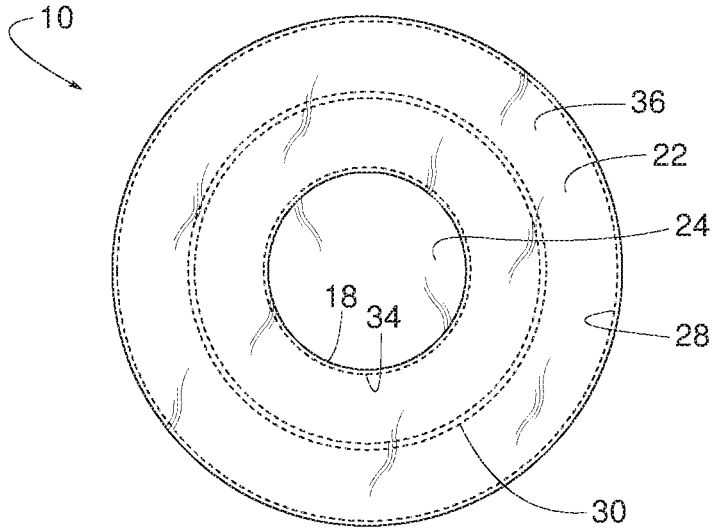
FIG. 2 is a top view of the example diffuser shown in FIG. 1.
Figure 3:
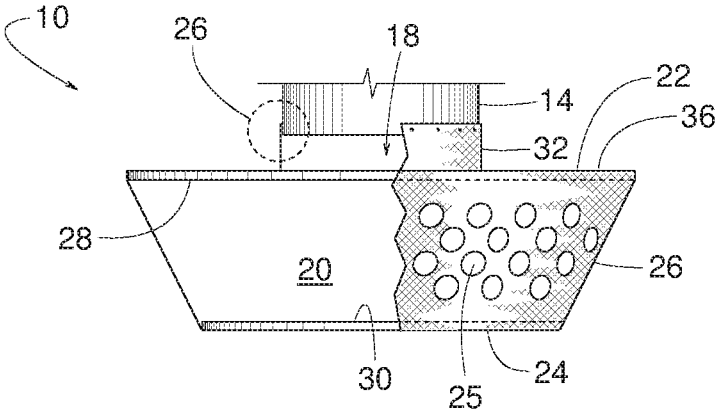
FIG. 3 is a front view of the example diffuser shown in FIG. 1, wherein a portion of the outer fabric is cut away to show the example diffuser's internal air chamber and one or more example hoops.

FIGS. 1-3 show various views of an example drop-down diffuser 10 mounted to an overhead supply air duct 12. In some examples, the supply air duct 12 is made of sheet metal and is in a generally rectangular shape. A cylindrical branch duct 14, also made of sheet metal, connects the supply air duct 12 to the diffuser 10. In other examples, the ducts 12, 14 are of other shapes and made of materials other than sheet metal. A blower or some other air-moving means forces air 16 in series flow through the supply air duct 12, down through the branch duct 14, through a supply air inlet 18 of the diffuser 10, and into an air chamber 20 of the diffuser 10. From the air chamber 20, the diffuser 10 disperses the air 16 into a room, area or other space surrounding the diffuser 10.

In some examples, the diffuser 10 is of a design that is lightweight, muffles airflow noise, muffles blower and/or other mechanical noises, evenly and/or strategically disperses air, reduces (e.g., minimizes) condensation on the surface of the diffuser, is machine washable, and is collapsible for compact packaging and shipping. In the example illustrated in FIGS. 1-3, the diffuser 10 comprises an upper panel 22, a lower panel 24, a circumferential fabric sheet 26, an upper hoop 28, a lower hoop 30, and a sleeve 32 connecting the upper panel 22 to the branch duct 14. In some examples, a central hoop 34 reinforces the area where the sleeve 32 connects to the upper panel 22. In the illustrated example, the upper panel 22 defines the supply air inlet 18, and the panels 22, 24 and the sheet 26 define the air chamber 20. As shown in the illustrated example, the lower hoop 30 is smaller than the upper hoop 28. As a result, the circumferential fabric sheet 26 is positioned at an angle to at least partially face downward, thereby facilitating the distribution of the air 16 into the space around and beneath the diffuser 10.

In the illustrated example, each of the upper panel 22, the lower panel 24, the sheet 26 and the sleeve 32 are made of a pliable fabric (e.g., polyester fabric, screen mesh, netting, etc.). Depending on the application, one or more areas of the fabric is air permeable either by a porous quality of the fabric itself and/or by a number of openings 25 cut into the fabric. In some examples, entire sections of the diffuser 10 are completely impervious to air. For instance, in some examples, the sleeve 32, the upper panel 22, and the lower panel 24 are impervious to air, while only the circumferential fabric sheet 26 is air permeable via the openings 25 and/or via porosity of the fabric itself. Examples of the diffuser 10 include all permeable/impermeable combinations of the upper panel 22, the lower panel 24, the sheet 26 and the sleeve 32.

To help prevent the diffuser 10 from sagging and to help prevent the diffuser's fabric from fluttering in turbulent air, some examples of the diffuser 10 include the upper hoop 28, the lower hoop 30 and/or the central hoop 34. The hoops 28, 30, 34 are relatively stiff compared to the fabric of the diffuser 10. Example hoop materials include metal, fiberglass, plastic, etc. In some examples, the upper hoop 28 holds an upper fabric sheet 36 of the upper panel 22 in radial tension, thus keeping the upper fabric sheet 36 generally taut.

Figure 4:
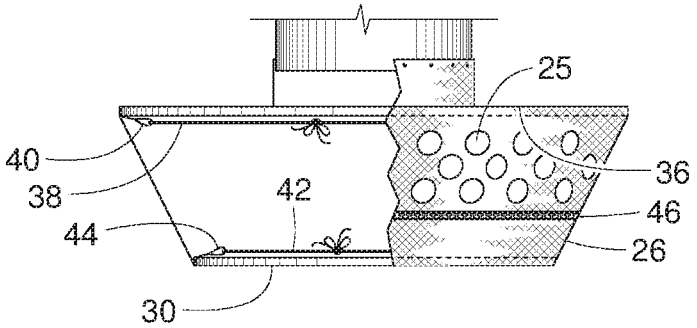
FIG. 4 is a front view similar to FIG. 3 but showing the addition of an example zipper and one or more example drawstrings.

To help hold upper hoop 28 in place and further hold the upper fabric sheet 36 of the upper panel 22 taut, some examples of the diffuser 10 include an upper drawstring 38, as shown in FIG. 4. The drawstring 38 extends through an upper loop of material 40 that runs circumferentially along a periphery of the upper panel 22 that is wrapped over the upper hoop 28. In some examples, the upper loop material 40 corresponds to a series of spaced apart loops distributed circumferentially along the periphery of the upper panel 22. Manually cinching the upper drawstring 38 exerts a constricting force that radially tightens the upper fabric sheet 36. In other examples, rather than wrapping around the upper hoop 28, the upper panel 22 includes one or more hooks attached thereto that extend circumferentially along the periphery of the upper panel 22 (e.g., extruded plastic hook(s) to latch on to the upper hoop 28. In such examples, cinching the drawstring 38 urges the hook(s) against the upper hoop 28 and exerts a radial tensile force across the upper panel 22 to keep the panel 22 taut.

Likewise, in some examples, the lower hoop 30 holds the lower panel 24 in radial tension. To increase the radial tension in the lower panel 24, some examples of diffuser 10 include a lower drawstring 42, as shown in FIG. 4. The lower drawstring 42 extends in a loop of material 44 that runs circumferentially along a periphery of the lower panel 24 that is wrapped over the lower hoop 30. In other examples, the lower drawstring 42 runs through a series of spaced apart loops distributed circumferentially along the periphery of the lower panel 22. Manually cinching the lower drawstring 42 exerts a constricting force that radially tightens the lower panel 24. The upper panel 22, the lower panel 24, and the circumferential fabric sheet 26 may be interconnected in any suitable manner such as, for example, via zippers, hook and loop fasteners, sewing, etc.

In the illustrated example, a zipper 46 (or comparable joint) provides means for manually accessing the drawstrings 38, 42. Although the zipper 46 is shown lying between and generally parallel to the hoops 28, 30, other examples of the diffuser 10 have the zipper 46 at any orientation and location on the diffuser 10. Example zipper locations include adjacent to the lower hoop 30, adjacent to the upper hoop 28, on the circumferential fabric sheet 26, on the upper panel 22, and on the lower panel 24. Thus, although the openings 25 are shown in the illustrated example as being above the zipper 46. in some examples, the openings 25 may be below the zipper 46. In other examples, there may be openings 25 both above and below the location of the zipper 46.

In some examples, the lower hoop 30 is suspended from the circumferential fabric sheet 26, which, in turn, is suspended from the upper hoop 28. That is, in some examples, the weight of the lower hoop 30 and/or the circumferential fabric sheet 26 is substantially supported by the upper hoop 28. In some examples, the weight of the lower hoop 28 keeps the circumferential fabric sheet 26 taut in a direction extending between the lower hoop 30 and the upper hoop 28.

Figure 5:
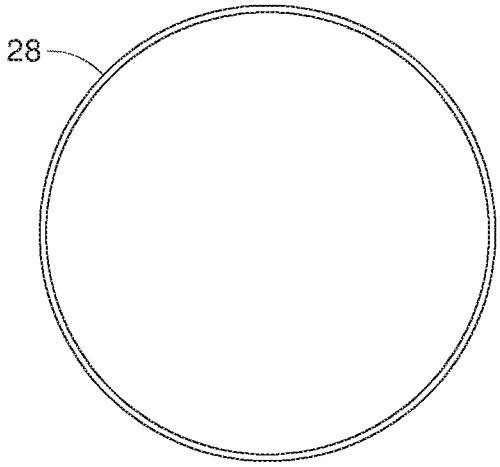
FIG. 5 is a top view of an example upper hoop constructed in accordance with the teachings disclosed herein.
Figure 6:
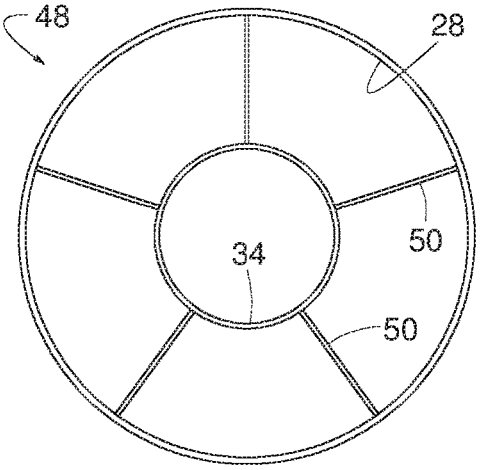
FIG. 6 is a top view of an example upper hoop, an example central hoop and example spokes constructed in accordance with the teachings disclosed herein.
Figure 7:
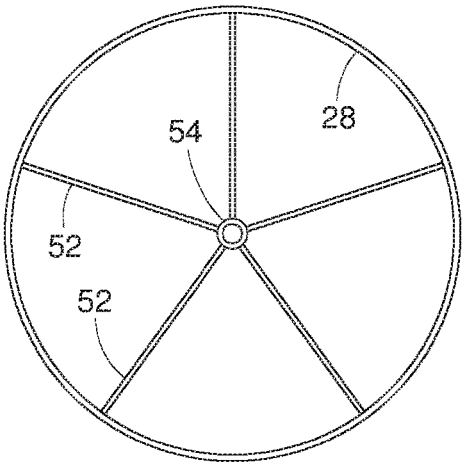
FIG. 7 is a top view of an example upper hoop, an example central hub and example spokes constructed in accordance with the teachings disclosed herein.
Figure 8:
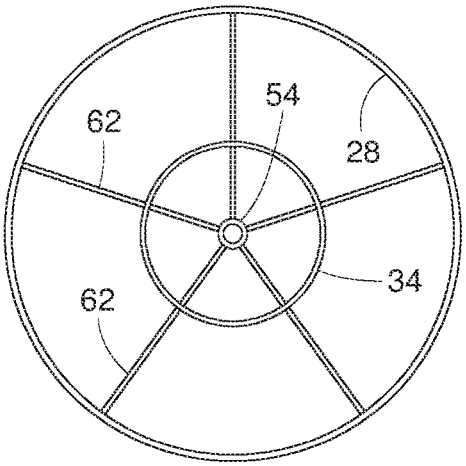
FIG. 8 is a top view of an example upper hoop, an example central hoop, example spokes and an example hub constructed in accordance with the teachings disclosed herein.

The hoops 28, 30, 34 can be of any imaginable shape and size. Some example hoop shapes include circular, rectangular, polygonal, and the shapes shown FIGS. 5-11. The illustrated example of FIG. 5 shows the upper hoop 28 as circular. FIG. 6 is an example hoop 48 comprising a plurality of spokes 50 connecting upper the hoop 28 to the central hoop 34. The illustrated example of FIG. 7 shows a plurality of spokes 52 extending radially between the upper hoop 28 and a hub 54. The hub 54 can be used for connecting to a vertically elongate compression member 56 (e.g., FIG. 22) or for providing an anchor point 58 from which to attach a vertically elongate tension member 60 (FIGS. 16, 17, 23 and 24). In other examples, the compression and tension members 56, 60 may be attached to a portion of one or more of the hoops 28, 30, 34 and/or one or more of the spokes 50. Examples of the vertically elongate compression member 56 include a rod, a shaft, a tube, a bar and/or any other member capable of carrying and transmitting compressive forces along its length. In some examples, the compressive forces arise due to vertical tension in the circumferential fabric sheet 26. In other words, the compression member 56 provides additional force beyond the weight of the lower hoop 30 to maintain the circumferential fabric sheet 26 taut between the upper and lower hoops 28, 30. Examples of the vertically elongate tension member 60 include a cord, a rope, a chain, a wire, a cable, a strap, and/or any other member capable of carrying and transmitting tensile forces along its length. The illustrated example of FIG. 8 shows a plurality of spokes 62 connecting the hub 54 and the central hoop 34 to the upper hoop 28. In some examples, the hoops 28, 30, 34 may include more than one hub to serve as different points of attachment for more than one compression member 56 and/or tension member 60. While the compression member 56 and the tension member 60 are shown and described in the illustrated examples as being vertically elongate, in some examples, the compression member 56 and/or the tension member 60 may be elongate in a non-vertical direction. For example, the compression member 56 and/or the tension member 60 may connect to the hoops 28, 30, 34, the spokes 50, and/or the hub 54 at an angle relative to the vertical direction.

Figure 9:
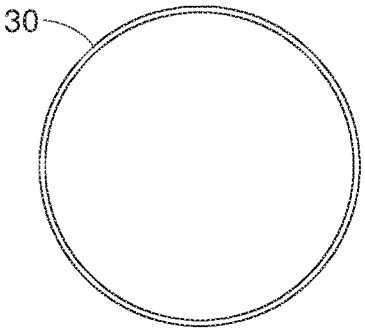
FIG. 9 is a top view of an example lower hoop constructed in accordance with the teachings disclosed herein.
Figure 10:
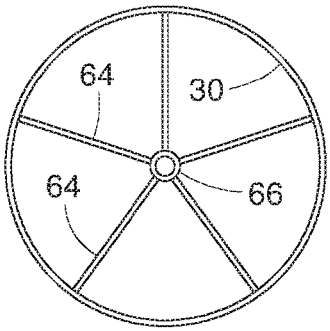
FIG. 10 is a top view of an example lower hoop, an example hub and example spokes constructed in accordance with the teachings disclosed herein.
Figure 11:
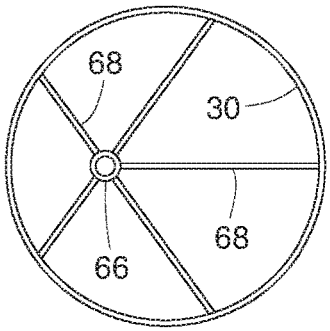
FIG. 11 is a top view of another example lower hoop, an example hub and example spokes constructed in accordance with the teachings disclosed herein.
Figure 22:
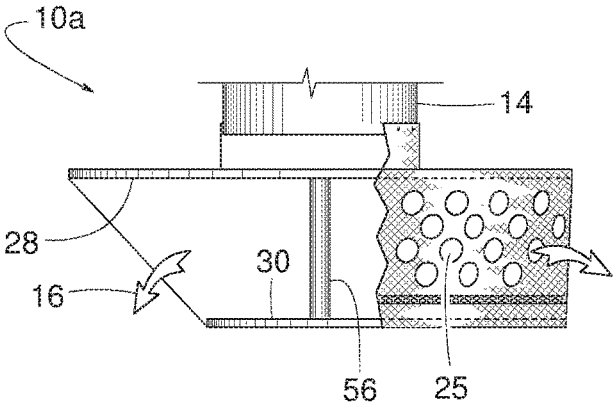
FIG. 22 is a front view similar to FIG. 4 but showing another example diffuser constructed in accordance with the teachings disclosed herein, wherein the example diffuser has a vertically elongate compression member that holds the example diffuser in a skewed configuration.

The illustrated example of FIG. 9 shows the lower hoop 30 as circular. The illustrated example of FIG. 10 shows a plurality of spokes 64 extending radially between the lower hoop 30 and a hub 66. In some examples, the elongate compression member 56 connects the hub 66 of FIG. 10 to the hub 54 of FIG. 8. The illustrated example of FIG. 11 shows an asymmetrical set of spokes 68 extending radially between the lower hoop 30 and the hub 66 to place the hub 66 at a radially offset position relative to the hoop 30. The hub's radially offset position in combination with the elongate compression member 56 connected to a radially centered hub 54 in the upper hoop 28 creates a skewed diffuser 10*a*, as shown in FIG. 22. The diffuser 10*a* of FIG. 22 is skewed in that the lower hoop 30 is not aligned or centered with the upper hoop 28. The misalignment of the upper and lower hoops 28, 30 results in the circumferential fabric sheet 26 having different angles (relative to a vertical direction) at different points around the diffuser 10. In some examples, at least one portion of the circumferential fabric sheet 26 is substantially vertical (e.g., the right-hand side of the diffuser 10*a* as illustrated in FIG. 22). The changes in the angle of the fabric sheet 26 also affect the shape or corresponding area of the sheet 26 facing away from the diffuser 10*a* in each direction. The changes in the shape, angle, and/or area of the circumferential sheet 26 may be used to control the direction and volume of the air 16 that is dispersed in each direction out of the diffuser 10.

Other examples of the diffuser 10 (e.g., diffusers 10*b-i*) are shown in FIGS. 12-25. In the example shown in FIGS. 12 and 13, the diffuser 10*b* includes a plurality of baffles 70 (e.g., five baffles). The baffles 70 help direct the air 16 through the diffuser 10*b*, and the baffles 70 can be of any quantity. Example baffle materials include fabric, metal, plastic, air permeable sheeting, and impermeable sheeting. In examples where the baffles 70 are made of fabric, the baffles 70 also help in muffling noise. In the example illustrated in FIG. 13, the baffles 70 extend up into the sleeve 32 for greater flow control and/or additional noise muffling.

Figure 12:
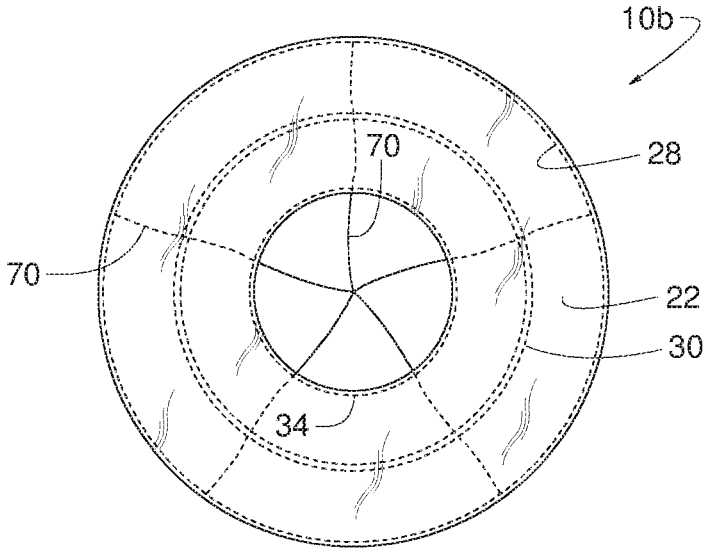
FIG. 12 is a top view similar to FIG. 2 but showing an example diffuser with a plurality of baffles, wherein the example diffuser is constructed in accordance with the teachings disclosed herein.
Figure 13:
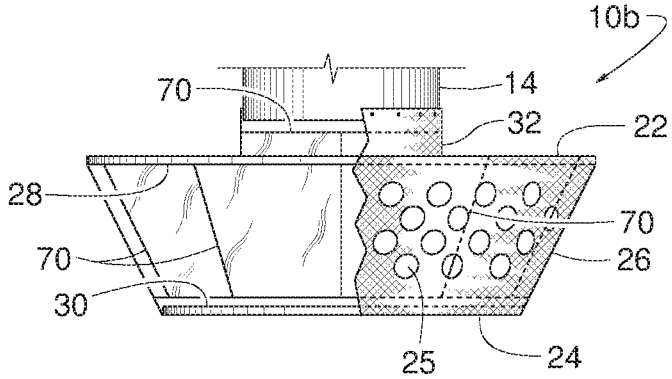
FIG. 13 is a front view of the example diffuser shown in FIG. 12, wherein a portion of the outer fabric is cut away to show the example diffuser's internal baffles.
Figure 14:
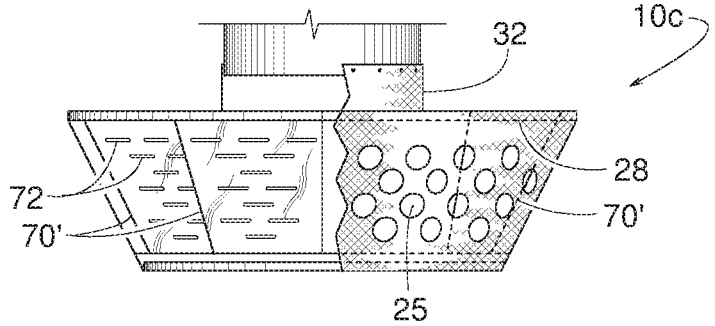
FIG. 14 is a front view similar to FIG. 13 but showing the example baffles having a plurality of openings.

The illustrated example of FIG. 14 shows the diffuser 10*c*, which is the same as the diffuser 10*b* of FIGS. 12 and 13 but with the addition of discrete air passage slits 72 in a lower profile baffle 70'. The baffles 70', being of a lower profile, do not extend up into the sleeve 32, thereby resulting in changes to the airflow characteristics through the diffuser 10*c*, which can be desirable in certain applications. The slits 72 (or comparable openings) also alter the airflow pattern. In some examples, the slits 72 shown in FIG. 14 may be implemented in conjunction with the higher profile baffles 70 shown in FIGS. 12 and 13. In some examples, the number and/or size of the slits 72 (or other openings) within the baffles 70 may differ on different ones of the baffles 70. In this manner, differences in airflow leaving the diffuser 10*c* at different points around its circumference may be established without changing an exterior appearance of the diffuser 10*c*. As a specific example, increases the quantity and/or size of slits within one side of the diffuser 10*c* would increase the airflow out that side of the diffuser 10*c*. Such an arrangement may be useful when the diffuser 10*c* is installed close to an exterior wall where it may be desirable to have greater airflow as compared to an interior region of the conditioned space surrounding the diffuser.

Figure 15:
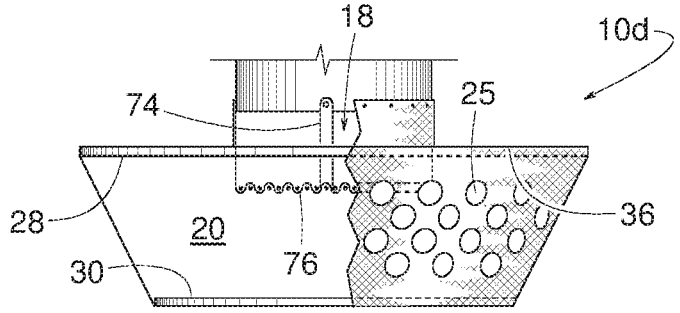
FIG. 15 is a front view similar to FIG. 3 but showing the example diffuser having an example internal screen.

The illustrated example of FIG. 15 shows the diffuser 10*d* with a bracket 74 suspending a screen 76 underneath the supply air inlet 18. The screen 76 may help distribute air 16 more evenly through air chamber 20. Example screen materials include wire screen, cloth mesh, fabric mesh, netting, and perforated sheet metal.

Figure 16:
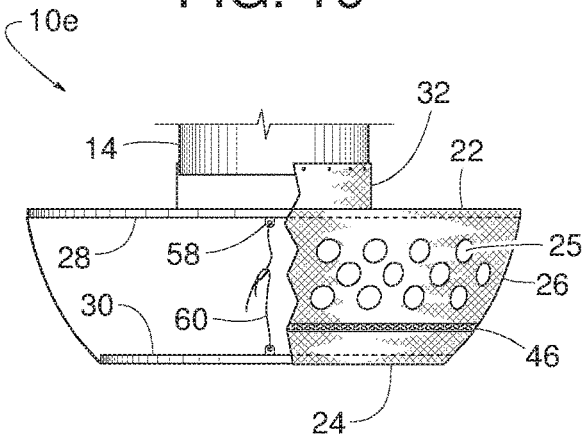
FIG. 16 is a front view similar to FIGS. 3 and 4 but showing an example diffuser with a vertically elongate tension member, wherein the example diffuser is constructed in accordance with the teachings disclosed herein.
Figure 17:
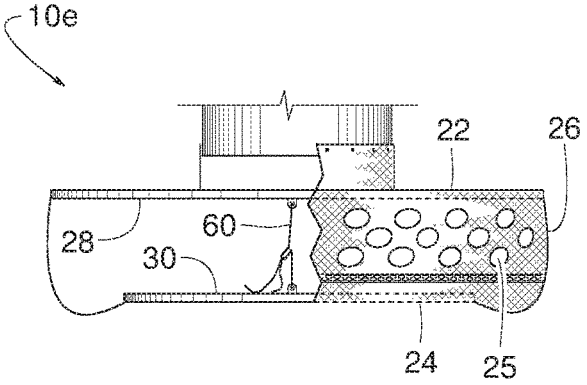
FIG. 17 is a front view similar to FIG. 16 but showing the example diffuser in another configuration.

The illustrated example of FIGS. 16 and 17 show the diffuser 10*e* with a suspension cord used as the elongate tension member 60. In some examples, an upper end of the tension member 60 connects to the upper hub 54 (FIGS. 7 and 8), and a lower end of the tension member 60 connects to the lower hub 66 (FIG. 10). In other examples, at least one of the tension member 60 connects to the spokes and/or the associated upper and lower hoops 28, 30. In some examples, both ends of the tension member 60 connect to the either the upper hoop 28 (and/or the associated hub and/or spokes) or the lower hoop 30 (and/or the associated hub and/or spokes) with a central region of the tension member 60 looping around the other one of the upper hoop 28, the lower hoop 30, and/or the associated hub and/or spokes, Further, while the tension member 60 is shown extending in the vertical direction, in some examples, the tension member (or portions thereof) may be angled relative to the vertical direction. In some examples, there may be more than one tension member 60. In some examples, manually adjusting the length of the tension member 60 adjusts the vertical separation between the hoops 28, 30. The illustrated example of FIG. 17, as compared to FIG. 16, shows the resulting change in the diffuser's shape upon shortening the length of tension member 60. Such a change in shape alters the diffuser's appearance and airflow characteristics, which may be desirable in certain applications. In some examples, the diffuser 10*e* includes more than one elongate tension member 60. In some examples, the one or more tension member 60 serves to assist in maintaining the lower panel 24 substantially parallel to the upper panel 22. In other examples, the tension member 60 may maintain the lower panel 24 in a position angularly offset relative to the upper panel 22.

Figure 18:
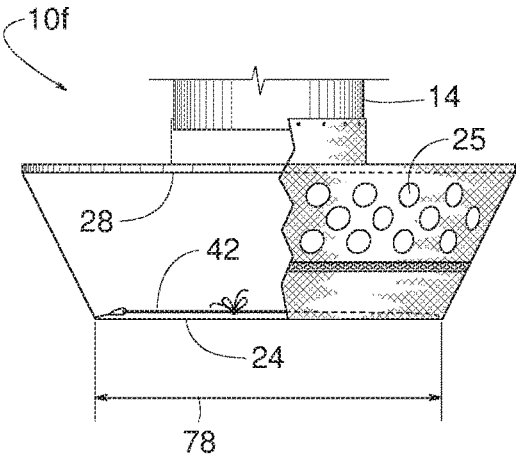
FIG. 18 is a front view similar to FIG. 4 but showing another example diffuser constructed in accordance with the teachings disclosed herein, wherein the example diffuser has a lower drawstring.
Figure 19:
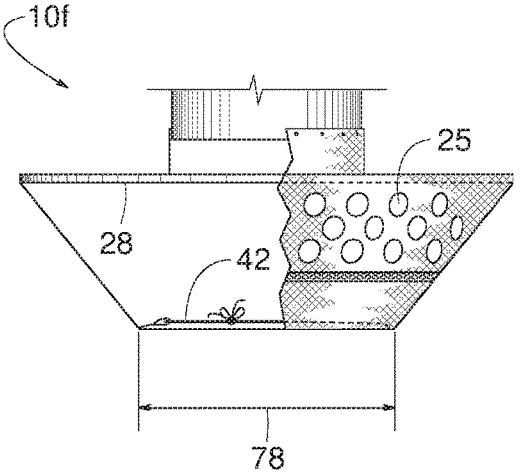
FIG. 19 is a front view similar to FIG. 18 but showing the example drawstring tighter.

The illustrated example of FIGS. 18 and 19 show the diffuser 10*f*, which is similar to the example shown in FIG. 4 but with the lower hoop 30 omitted. Without the lower hoop 30 keeping the lower panel 24 taut, tightening the drawstring 42 provides a means for adjusting the lower panel's diameter 78, and thus provides a means for adjusting the pattern and/or volume of air 16 discharging from diffuser 10*f*. FIG. 19, as compared to FIG. 18, shows the resulting change in the lower panel's diameter 78 upon tightening the drawstring 42. In some such examples, the lower panel 24 includes a metal split ring spring that expands or contracts in diameter in accordance with the tightening and loosening of the drawstring 42. In some examples, the lower panel 24 is made of an elastic material to stretch or contract with associated changes in the diameter of the panel 24. In other examples, the lower panel 24 may be non-elastic and may bunch together as the diameter is decreased.

Figure 20:
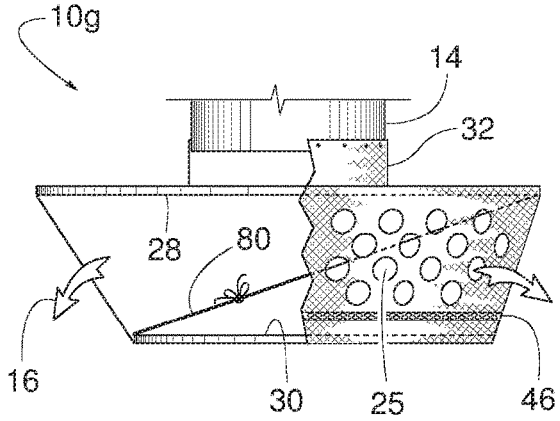
FIG. 20 is a front view similar to FIG. 4 but showing another example diffuser constructed in accordance with the teachings disclosed herein, wherein the example diffuser has a diagonal drawstring.
Figure 21:
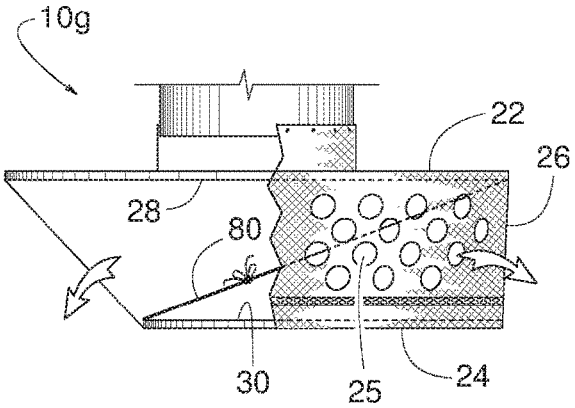
FIG. 21 is a front view similar to FIG. 20 but showing the example drawstring tighter.

The illustrated example of FIGS. 20 and 21 show diffuser 10*g*, which is similar to the example shown in FIGS. 1-3 but with the addition of a tension member 80 (e.g., cord, rope, chain, wire, cable, strap, etc.) extending diagonally between the upper and lower hoops 28, 30. Varying the length of the tension member 80 adjusts the amount of skew or lateral offset of the lower hoop 30 relative to the upper hoop 28. The illustrated example of FIGS. 20 and 21 show the change in skew of the diffuser 10*g* as a result of tightening tension member 80. In some examples, the diffuser 10*g* includes more than one tension member 80, each of which may be adjusted to the same or different tightness as other tension members and have the same or different angle as other tension members, thereby enabling control of the shape (e.g., skew) of the diffuser 10*g*. Such a change in shape alters the diffuser's appearance and airflow characteristics, which may be desirable in certain applications.

Figure 23:
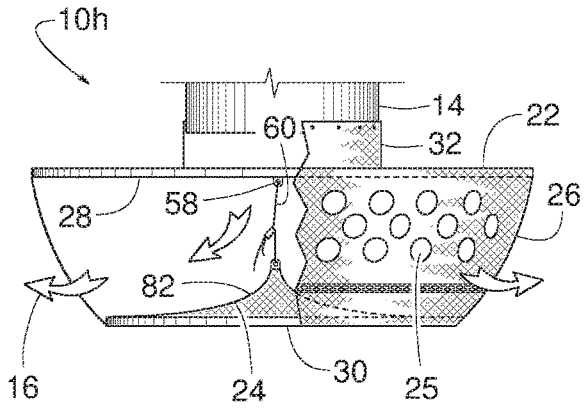
FIG. 23 is a front view similar to FIG. 4 but showing another example diffuser constructed in accordance with the teachings disclosed herein, wherein the example diffuser has a vertical elongate tension member that forces the example diffuser's lower panel into the shape of a curved cone.
Figure 24:
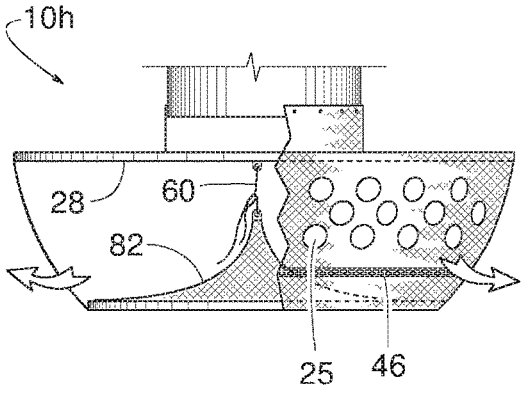
FIG. 24 is a front view similar to FIG. 23 but showing the example vertically elongate tension member tighter.

The illustrated example of FIGS. 23 and 24 shows the diffuser 10*h*, which uses the elongate tension member 60 that pulls on a central point of the lower panel 24 to create a curved cone 82 to direct the air 16 within the chamber 20 of the diffuser 10*h* in a more radial outward direction. FIG. 24, as compared to FIG. 23, shows the curved cone's change in shape as a result of tightening the tension member 60. In some examples, the lower panel 24 is air permeable. In other examples, the lower panel 24 is impervious to air.

Figure 25:
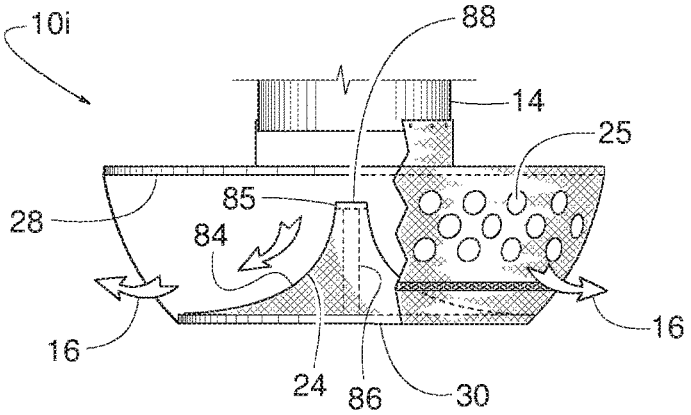
FIG. 25 is a front view similar to FIG. 4 but showing another example diffuser constructed in accordance with the teachings disclosed herein, wherein the example diffuser has a vertical elongate compression member that forces the example diffuser's lower panel into the shape of a curved cone.

A similar curved cone 84 can be created as shown in the illustrated example diffuser 10*i* of FIG. 25. In this example, the lower end of an elongate compression member 86 (e.g., tube, rod, bar, etc.) is attached to the lower hoop's central hub 66 (e.g., the hub 66 of FIG. 10) and extends upward to push up and elevate a central portion 88 of the lower panel 24. In the illustrated example, a disk 85 with a diameter larger than the compression member 86 helps distribute the pressure that the compression member 86 exerts upward against lower panel 24. In some examples, the disk 85 also helps deflect the incoming supply air 16 radially outward. In some examples, the length of the compression member 86 is manually adjustable. For example, the compression member 86 may include telescopic tubes that can be adjusted and fixed in place via spring push-buttons that extend through holes in the tubes.

Figure 26:
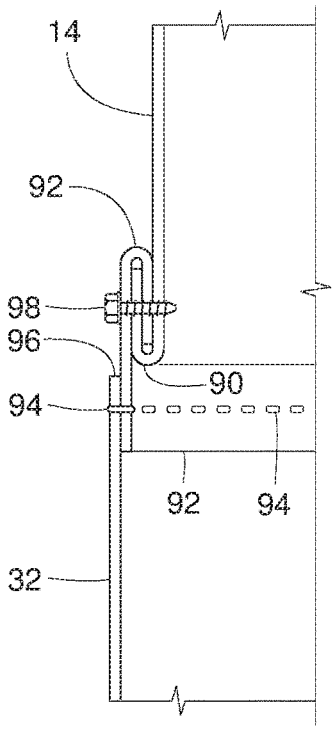
FIG. 26 is an enlarged view of an example joint within an encircled area of FIG. 3.
Figure 27:
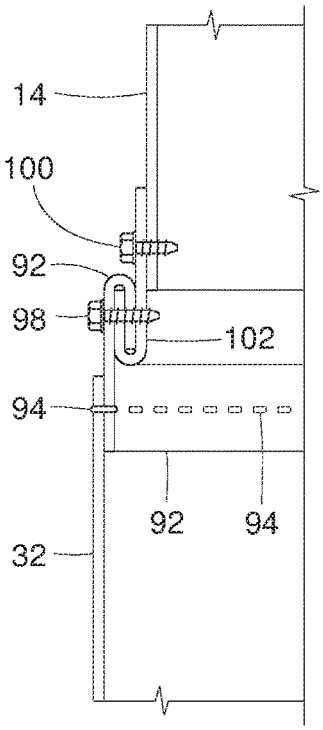
FIG. 27 is a view similar to FIG. 26 but showing an alternate example joint constructed in accordance with the teachings disclosed herein.
Figure 28:
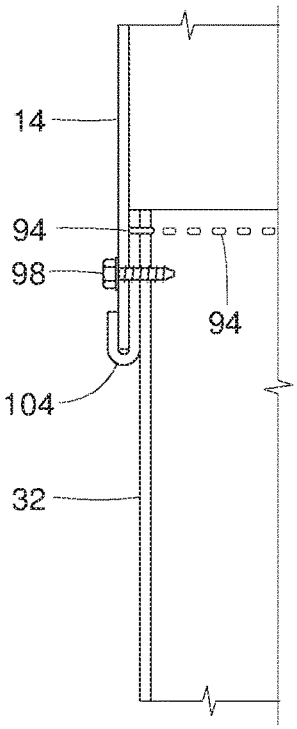
FIG. 28 is a view similar to FIGS. 26 and 27 but showing another alternate example joint constructed in accordance with the teachings disclosed herein.

FIGS. 26-28 show various example means for connecting the fabric sleeve 32 to the sheet metal branch duct 14. In the example shown in FIG. 26, the duct 14 has an integral sheet metal channel 90 around its outer periphery. A mating plastic adaptor 92 is sewn (see thread 94) or otherwise attached to an upper edge 96 of the fabric sleeve 32. Although the adaptor 92 can be made of almost any material, some examples of the adaptor 92 are made of TPV (thermoplastic vulcanizate), as this material can be readily sewn by conventional means. In the illustrated example, a first plurality of self-tapping screws 98 fasten the adaptor 92 to the duct 14 while the thread 94 fastens the adaptor 92 to the sleeve 32.

In the example shown in FIG. 27, a second plurality of screws 100 fasten a separate channel 102 to the duct 14, which is an alternative to the duct 14 having the integral channel 90. Then, similar to the example shown in FIG. 26, the plastic adaptor 92 and the first plurality of screws 98 connect the sleeve 32 to the channel 102. In the example shown in FIG. 28, a channel 104 is sewn or otherwise attached to the sleeve 32, and the screws 98 fasten the sleeve 32 and the channel 104 to the duct 14.

In some examples, the concept of using one or more tension members 60 for adjusting the outer shape of a diffuser (FIGS. 16, 17, 23 and 24) is applied to adjusting the shape of a diffuser's internal baffle assembly, as shown in FIGS. 29-36. In the example shown in FIGS. 29 and 30, a diffuser 10*j* includes the circumferential fabric sheet 26 surrounding an internal fabric baffle 106. In the illustrated example, the internal fabric baffle 106 has a generally circular upper edge 108 zipped or otherwise attached to the sleeve 32 and/or to the upper panel 22 along the circumference or periphery of the supply air inlet 18. The internal baffle 106, in some examples, is a fabric mesh that allows the air 16 to pass through it. In the illustrated example, the lower end of the tension member 60 is attached to a circular base 110 connected to the internal baffle 106. Examples of circular base 110 include a hoop, a metal screen disc, a fabric mesh, and a disc impervious to air. The upper edge 108 and the base 110 can be of any shape and is not necessarily circular.

Figure 29:
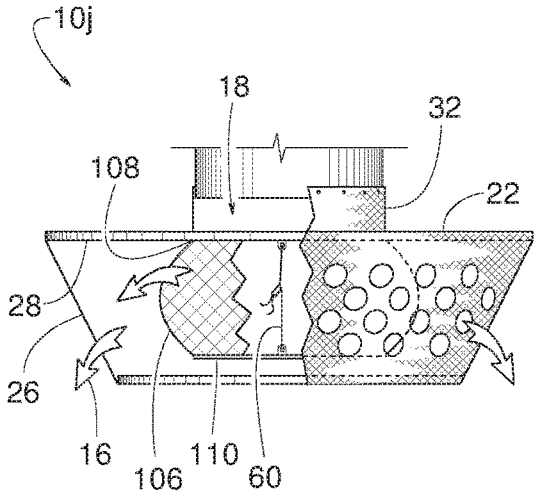
FIG. 29 is a front view similar to FIG. 3 but showing another example diffuser constructed in accordance with the teaching disclosed herein, wherein portions of the outer fabric and an example inner baffle are cut away to show internal features of the example diffuser.
Figure 30:
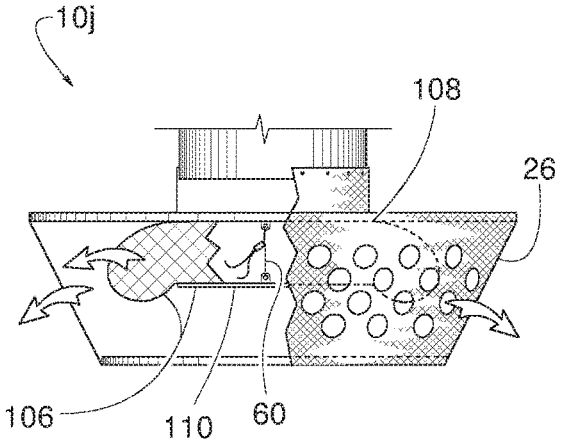
FIG. 30 is a front view similar to FIG. 29 but showing the example diffuser in another configuration.

Manually adjusting the length of tension member 60 adjusts the vertical separation between the upper hoop 28 and the base 110. The illustrated example of FIG. 30, as compared to FIG. 29, shows the resulting change in the shape of the internal baffle assembly upon shortening the length of the tension member 60. Such a change in the shape of the internal baffle assembly may alter the airflow characteristics of the diffuser 10*j* and does so generally without altering the diffuser's outer appearance, which may be desirable in certain applications.

Figure 31:
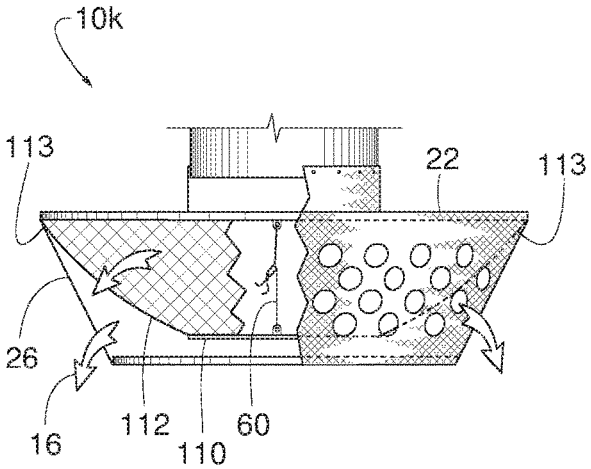
FIG. 31 is a front view similar to FIG. 29 but showing another example diffuser constructed in accordance with the teachings disclosed herein.
Figure 32:
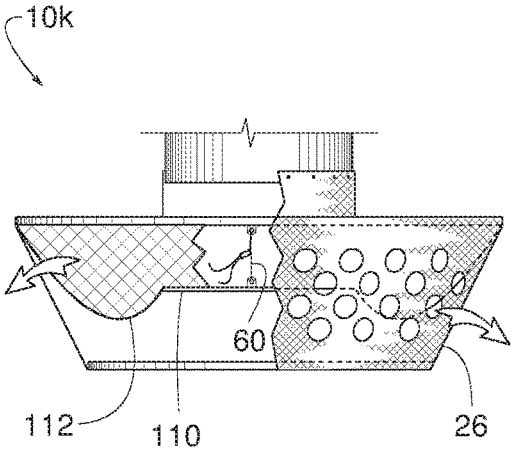
FIG. 32 is a front view similar to FIG. 31 but showing the example diffuser in another configuration.

In the example shown in FIGS. 31 and 32, a diffuser 10*k* includes the circumferential fabric sheet 26 surrounding an internal fabric baffle 112. In the illustrated example, the internal fabric baffle 112 has a generally circular upper edge 113 zipped or otherwise attached to the outer periphery of upper panel 22. The internal baffle 112, in some examples, is a fabric mesh that allows the air 16 to pass through it. In the illustrated example, the lower end of the tension member 60 is attached to the base 110.

Manually adjusting the length of the tension member 60 adjusts the vertical separation between the upper panel 22 and the base 110. The illustrated example of FIG. 32, as compared to FIG. 31, shows the resulting change in the shape of the internal fabric baffle 112 upon shortening the length of the tension member 60. Such a change in shape may alter the airflow characteristics of the diffuser 10*k* and does so generally without altering the diffuser's outer appearance, which may be desirable in certain applications.

Figure 33:
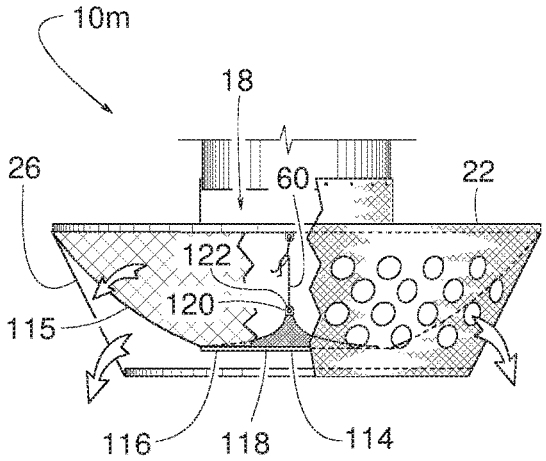
FIG. 33 is a front view similar to FIGS. 29 and 31 but showing another example diffuser constructed in accordance with the teachings disclosed herein.
Figure 34:
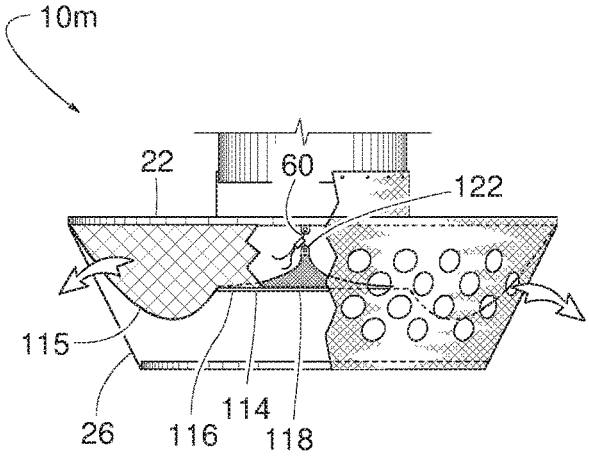
FIG. 34 is a front view similar to FIG. 33 but showing the example diffuser in another configuration.

A diffuser 10*m*, shown in the illustrated example of FIGS. 33 and 34, is similar to diffuser 10*k* of FIGS. 31 and 32; however, an internal fabric baffle 115 of the diffuser 10*m* comprises a base 114 with a hoop 116 supporting a fabric disc 118 (porous or nonporous fabric). Tension in the elongate member 60 pulls on a central point 120 of fabric disc 118 to create a curved conical shape with an apex 122 pointing toward the supply air inlet 18. The curved conical shape of the fabric disc 118 provides an air-guiding function similar to that of the curved cone 82 of FIGS. 23 and 24.

Manually adjusting the length of the tension member 60 adjusts the vertical separation between the upper panel 22 and the base 114. The illustrated example of FIG. 34, as compared to FIG. 33, shows the resulting change in the shape of the internal fabric baffle 115 upon shortening the length of the tension member 60. Such a change in the internal baffle's shape may alter the airflow characteristics of diffuser 10*m* and does so generally without altering the diffuser's outer appearance, which may be desirable in certain applications.

Figure 35:
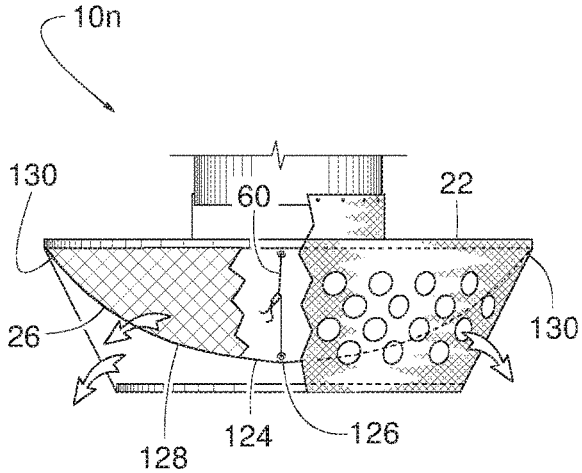
FIG. 35 is a front view similar to FIGS. 29, 31 and 33 but showing another example diffuser constructed in accordance with the teachings disclosed herein.
Figure 36:
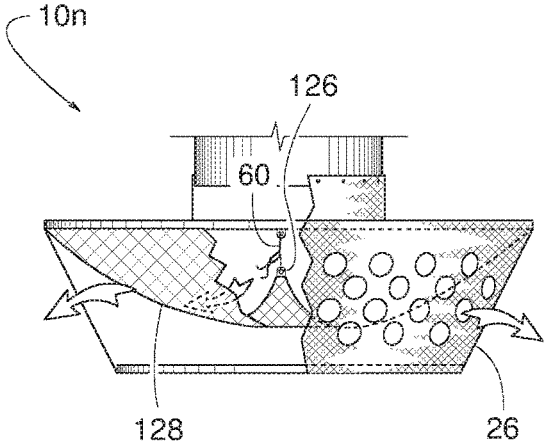
FIG. 36 is a front view similar to FIG. 35 but showing the example diffuser in another configuration.

A diffuser 10*n*, shown in the illustrated example of FIGS. 35 and 36, is similar to the diffuser 10*m*; however, a base 124 of the diffuser 10*n* has no hoop 116 for supporting the fabric disc 118. Instead, the elongate member 60 pulls on a central point 126 of an air-permeable internal fabric baffle 128. An upper outer periphery 130 of the internal baffle 128 is zipped or is otherwise attached to the outer periphery of the upper panel 22. Tension in the elongate member 60 pulls on the central point 126 of the internal baffle 128 to create a curved conical shape. The curved conical shape of the internal baffle 128 provides an air-guiding function similar to that of the curved cone 82 of FIGS. 23 and 24.

Manually adjusting the length of the tension member 60 adjusts the vertical separation between the upper panel 22 and the central point 126. The illustrated example of FIG. 36, as compared to FIG. 35, shows the resulting change in the shape of the internal baffle 128 upon shortening the length of the tension member 60. Such a change in the internal baffle's shape may alter the airflow characteristics of diffuser 10*n* and does so generally without altering the diffuser's outer appearance, which may be desirable in certain applications. In each of the examples shown in FIGS. 29-36, the internal fabric baffle 106, 112, 115, 128 is adjustable selectively to a plurality of positions by simply adjusting the length of the elongate member 60.

Some drop-down diffusers disclosed herein are mounted in one or more panels of a ceiling. For example, drop-down diffusers may be installed in a laboratory to provide targeted air flow to mitigate toxic fumes. Some example drop-down diffusers disclosed herein output a low volume of air, but improve (e.g., optimize) the airflow to intelligently provide fresh air where it is most needed (e.g., an area of a contaminant). For example, some drop-down diffusers disclosed herein include blanking panels that occlude or obstruct airflow at particular portions of a diffuser to enable targeted airflow in low-airflow situations, thereby saving energy and improving (e.g., optimizing) ventilation effectiveness.

Figure 37:
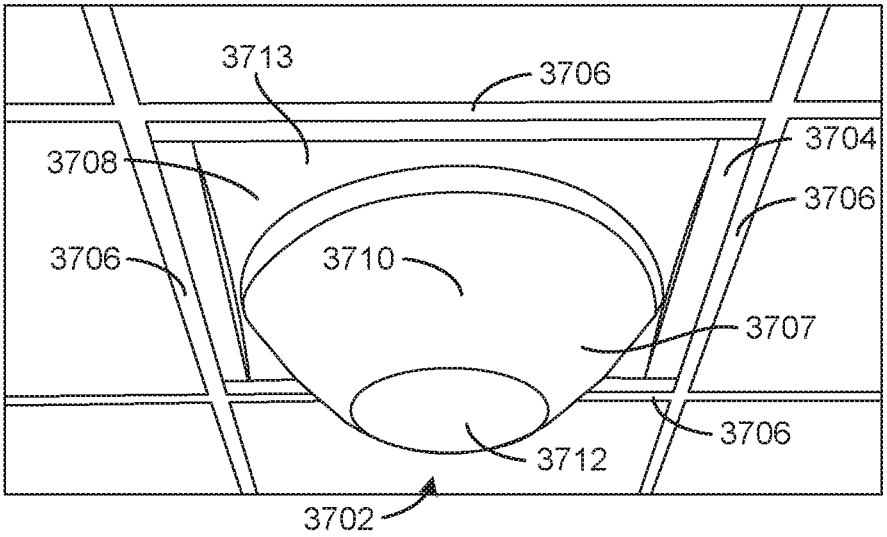
FIG. 37 is a front view of another example drop-down diffuser mounted to an example mounting pan in a ceiling.
Figure 38:
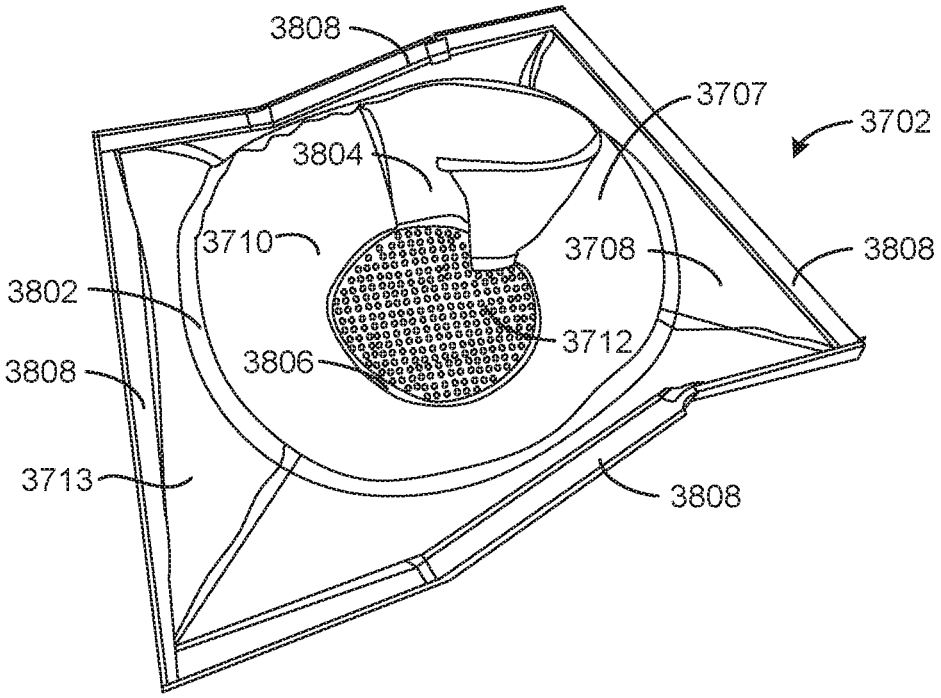
FIG. 38 is a top perspective view of the drop-down diffuser of FIG. 37, not installed in the ceiling.

An example drop-down diffuser 3702 installed in a ceiling is shown in FIG. 37. FIG. 38 illustrates a top view of the drop-down diffuser 3702 when not installed in the ceiling. The example drop-down diffuser 3702 of the illustrated examples is mounted in place of a ceiling panel (e.g., a 2'×2' grid panel of a ceiling, etc.) via an example mounting pan 3704 which is itself mounted to one or more example ceiling grid components 3706 (e.g., ceiling grid cross tees, ceiling wall moldings, ceiling grid main tees, suspension grid components, etc.). In some examples, the drop-down diffuser 3702 is mounted to the ceiling directly, without being connected to the mounting pan 3704. The upper portion 3708 of the example drop-down diffuser is removably connected to the mounting pan 3704.

The lower portion 3707 of the example drop-down diffuser 3702 includes an example first pliable material or fabric sheet 3710 and an example second pliable material or fabric sheet 3712 connected to the first fabric sheet 3710. In some examples, the second fabric sheet 3712 is connected to the first fabric sheet 3710 via a seam (e.g., a fabric seam). In some examples, the first fabric sheet 3710 and the second fabric sheet 3712 are a single fabric sheet. In some examples, the second fabric sheet 3712 has a higher permeability and/or porosity than the first fabric sheet 3710, thus enabling more air flow through the second fabric sheet 3712 (e.g., air flow directed downward out of the drop-down diffuser 3702) than the first fabric sheet 3710. In other examples, the first fabric sheet 3710 has a higher permeability and/or porosity than the second fabric sheet 3712 to enable higher air flow through the sides of the drop-down diffuser 3702 (e.g., through the first fabric sheet 3710). In some examples, the first fabric sheet 3710 and the second fabric sheet 3712 have the same permeability and/or porosity. In some examples, the upper portion 3708 of the example drop-down diffuser 3702 includes a third pliable material or fabric sheet 3713. In some examples, the first fabric sheet 3710 has a higher permeability and/or porosity than the third fabric sheet 3713.

In the illustrated example, the second fabric sheet 3712 is circular and the first fabric sheet 3710 wraps around a circumference of the second fabric sheet 3712 in a generally frustoconical shape. The first fabric sheet 3710 and the second fabric sheet 3712 can be of any shape (e.g., circular, triangular, rectangular, etc.). The lower portion 3707 of the example drop-down diffuser 3702 is attached to the upper portion 3708 to surround an opening in the upper portion 3708. More particularly, the first fabric sheet 3710 of the lower portion 3707 is removably connected to the upper portion 3708 (e.g., via a zipper, via a hook-and-loop connection, etc.) at a perimeter of a circular opening of the upper portion 3708. In some examples, the opening in the upper portion 3708 may have a different geometry (e.g., rectangular, triangular, etc.). In some examples, the first fabric sheet 3710 (and/or the associated lower portion 3707) is integral to the upper portion 3708, and/or is permanently connected to the upper portion 3708 (e.g., via adhesive, via a seam, etc.).

In the top perspective view of FIG. 38, an example connection 3802 between the upper portion 3708 and the lower portion 3707 is visible. In the illustrated example, the connection 3802 is a zipper connection, where the zipper is located on the opposing side of the connection 3802 to that shown in FIG. 38 (e.g., on an exterior surface of the drop-down diffuser 3702 when it is mounted). In some examples, the connection 3802 is a hook-and-loop style connection, where a first side of the hook-and-loop style connection (e.g., a strip of hooks or a strip of loops) is pressed against the opposite side of the hook-and-loop style connection (e.g., a strip of hooks, if the first side was a strip of loops, etc.) to connect the first fabric sheet 3710 of the lower portion 3707 and the third fabric sheet 3713 of the upper portion 3708. Any other connection type may be utilized to removably couple the upper portion 3708 and the lower portion 3707.

Figure 39:
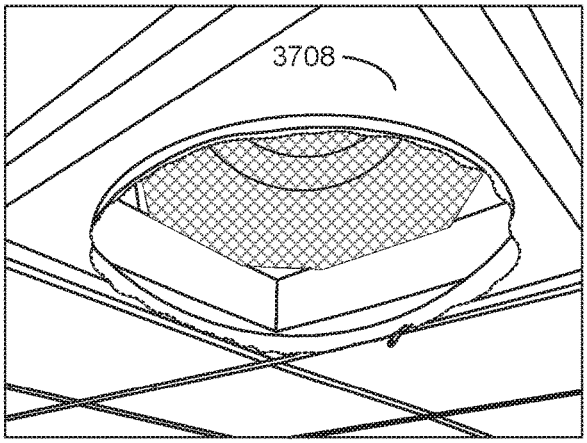
FIG. 39 is a bottom perspective view of an example upper portion of the drop-down diffuser of FIG. 37 with an example lower portion of the drop-down diffuser detached.
Figure 40:
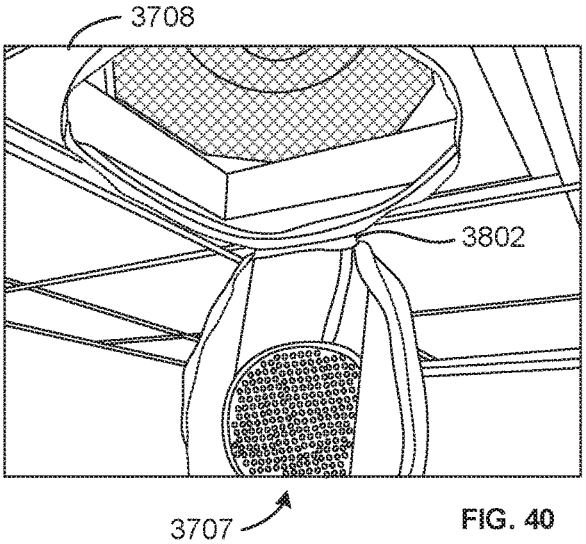
FIG. 40 is a view similar to FIG. 39, but with the lower portion of the drop-down diffuser partially coupled to the upper portion of the drop-down diffuser.
Figure 41:
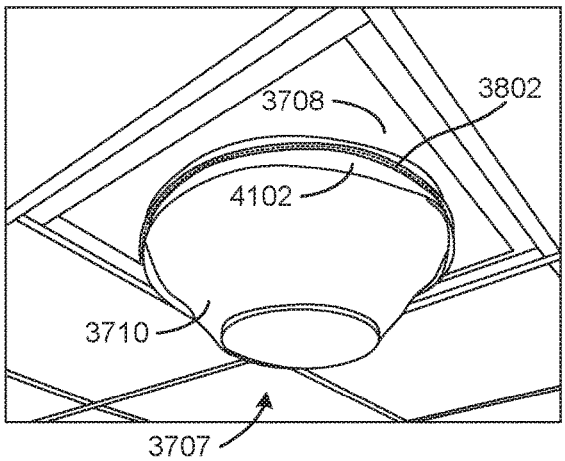
FIG. 41 is a view similar to FIG. 40, but with the lower portion of the drop-down diffuser fully coupled to the upper portion of the drop-down diffuser.
Figure 42:
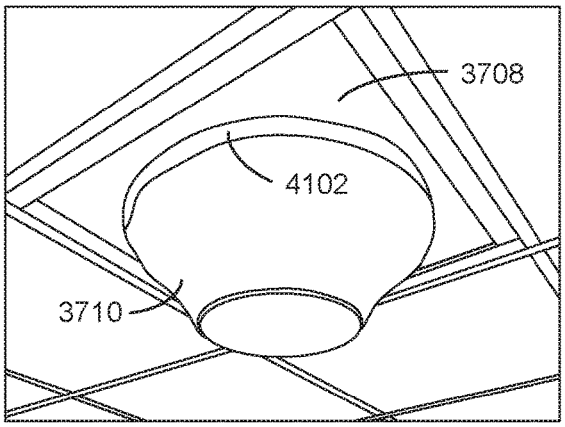
FIG. 42 is a view similar to FIG. 41, but with an example connection cover in a position to conceal the connection between the lower portion of the drop-down diffuser and the upper portion of the drop-down diffuser.

FIGS. 39-42 depict stages of utilizing the connection 3802 to attach the lower portion 3707 to the upper portion 3708. In the illustrated example of FIG. 39, the lower portion 3707 is completely detached to expose the opening in the upper portion of the diffuser 3702. In the illustrated example of FIG. 40, the lower portion 3707 is partially attached to the upper portion 3708 along the connection 3802. FIGS. 41 and 42 illustrate the example lower portion 3707 of the diffuser 3702 fully connected to the upper portion 3708. The illustrated example of FIG. 41 differs from the illustrated of FIG. 42 in that an example connection cover 4102 is flipped down in FIG. 41 to expose and/or provide access to the example connection 3802 whereas the connection cover 4102 is flipped up to cover the connection 3802 for improved appearance. In the illustrated example, the connection cover 4102 is attached to the lower portion 3703 of the drop-down diffuser 3702. In other examples, the connection cover 4102 may be attached to the upper portion 3708.

In the position illustrated in FIG. 40, an operator could adjust positioning of one or more blanking panels without fully decoupling the lower portion 3707 of the drop-down diffuser 3702 from the upper portion 3708 of the drop-down diffuser 3702. An example blanking panel 3804 is shown in the illustrated example of FIG. 38. The example blanking panel 3804 of the illustrated example may be removably disposed within the drop-down diffuser 3702 to inhibit, reduce, and/or block air from passing through the portion of the diffuser covered by the blanking panels 3804. In some examples, the blanking panel 3804 has a permeability and/or porosity that is less than at least one of the first fabric sheet 3710, the second fabric sheet 3712, and/or the third fabric sheet 3713. Thus, when blanking panels 3804 are placed over one or more of the first fabric sheet 3710, the second fabric sheet 3712, and/or the third fabric sheet 3713, the distribution of air flow out of the drop-down diffuser 3702 is altered such that air flow is increased out of areas where the blanking panels 3804 are not present. In some examples, the blanking panels 3804 are composed of plastic, fiber, metal, polycarbonate, leather, and/or any other material to reduce air flow through a portion of the drop-down diffuser 3702.

In the illustrated example of FIG. 38, the blanking panel 3804 is a pliable material or fabric sheet partially attached to the drop-down diffuser 3702 and positioned to cover a portion of the first fabric sheet 3710 to reduce airflow through the covered portion. In the illustrated example, the blanking panel 3804 is a partial arch shape, covering approximately 120 degrees of the circumference of the first fabric sheet 3710. In some examples, the blanking panel 3804 is an arch of different dimensions to cover a different circumferential portion of the first fabric sheet 3710 (e.g., 90 degrees, 180 degrees, 270 degrees, etc.). In some examples, the blanking panel 3804 is a rectangular shape, a triangular shape, a circular shape, and/or any other shape.

In some examples, where the connection 3802 between the first fabric sheet 3710 and the upper portion 3708 is a zipper connection, a hook-and-loop connection, and/or another easily-adjustable connection type, an operator can remove the first fabric sheet 3710 from the upper portion 3708 to adjust positions of one or more blanking panel(s) 3804. In some examples, the blanking panel 3804 connects to a first coupling structure (e.g., a hook-and-loop strip, mounting tape, magnetic tape, zipper, hook(s), buttons, etc.) located on or adjacent to an example lower seam 3806 (e.g., connecting the first and second sheets 3710, 3712) and a second coupling structure located on or adjacent to an internal surface of the connection 3802. The blanking panel 3804 of the illustrated example has a matching coupling structure (e.g., the opposing end of a hook-and-loop connection) to enable attachment. In some examples, additional coupling structures can be placed in the drop-down diffuser 3702 at different locations to enable attachment of the blanking panel 3804. For example, additional coupling structures (e.g., hook-and-loop connection strips) can be added at any suitable location on the first fabric sheet 3710, the second fabric sheet 3712, and/or the third fabric sheet 3713.

The air flow through the drop-down diffuser 3702 can be carefully controlled based on the shape, number, and/or placement of blanking panels inside the drop-down diffuser 3702 covering areas of the first fabric sheet 3710, the second fabric sheet 3712, and/or the third fabric sheet 3713. For example, FIGS. 43-50 depict example positions of blanking panels that can be advantageously employed to direct air flow through drop-down diffusers.

Figure 43:
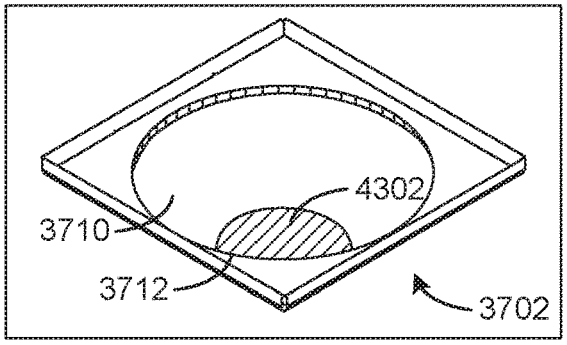
FIG. 43 is a top perspective view of the drop-down diffuser of FIG. 37 utilizing an example first blanking panel arrangement.
Figure 44:
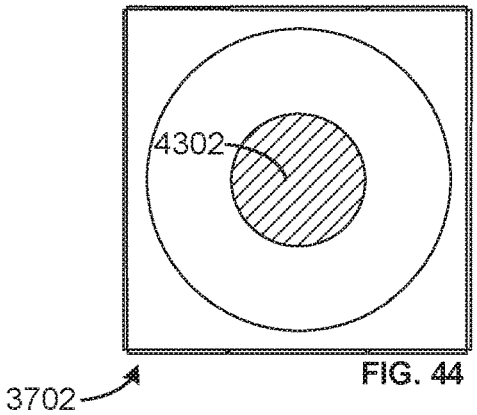
FIG. 44 is a top view of the drop-down diffuser of FIG. 43.
Figure 45:
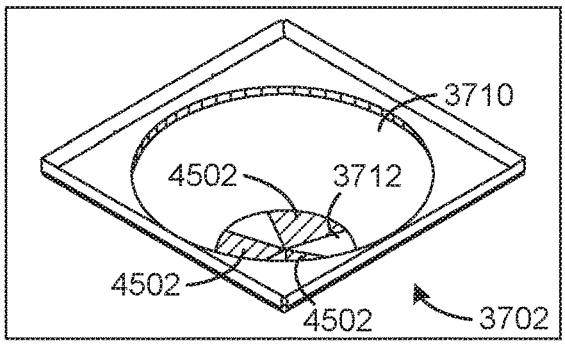
FIG. 45 is a view similar to FIG. 43 but showing the example drop-down diffuser utilizing an example second blanking panel arrangement.
Figure 46:
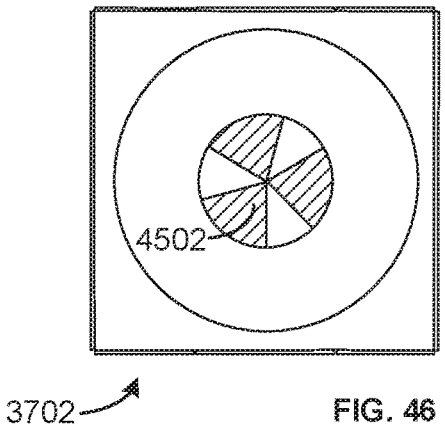
FIG. 46 is a top view of the drop-down diffuser of FIG. 45.

In the illustrated example of FIG. 43, the drop-down diffuser 3702 includes an example first blanking panel arrangement 4302. The first blanking panel arrangement 4302 of the illustrated example covers the second fabric sheet 3712 with one blanking panel, without covering the first fabric sheet 3710. Thus, air flow through the drop-down diffuser 3702 is dispersed out the sides of the drop-down diffuser 3702, through the first fabric sheet 3710. FIG. 44 is a top view of the drop-down diffuser 3702 of FIG. 43, depicting the first blanking panel arrangement 4302. Alternatively, FIG. 45 illustrates a top perspective view of the example drop-down diffuser 3702 including a second blanking panel arrangement 4502. The second blanking panel arrangement 4502 of the illustrated example covers portions of the second fabric sheet 3712, without covering the first fabric sheet 3710. The second blanking panel arrangement 4502 includes three blanking panels which are sectors of the circle of the second fabric sheet 3712. The blanking panels of the second blanking panel arrangement 4502 of the illustrated example are evenly distributed around the circle. The second blanking panel arrangement 4502 reduces air flow through the second fabric sheet 3712, while evenly distributing the air flow to different sectors of the circular shape of the second fabric sheet 3712. FIG. 46 is a top view of the drop-down diffuser 3702 of FIG. 45, depicting the second blanking panel arrangement 4502.

Figure 47:
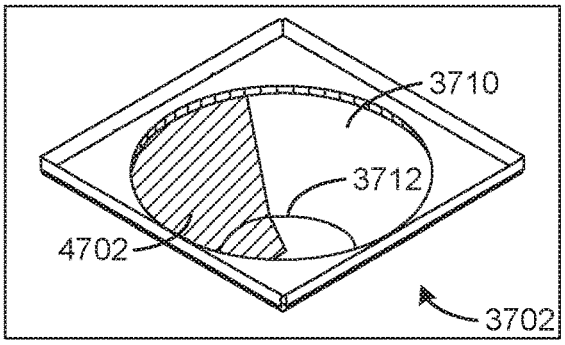
FIG. 47 is a view similar to FIG. 43 but showing the example drop-down diffuser utilizing an example third blanking panel arrangement.
Figure 48:
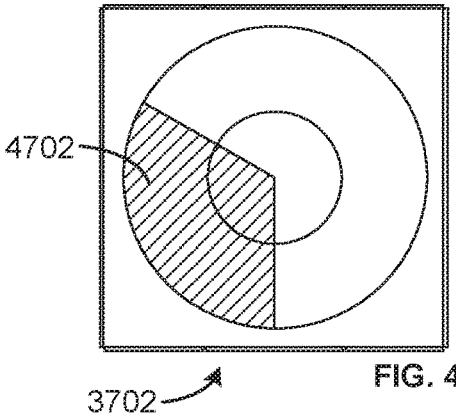
FIG. 48 is a top view of the drop-down diffuser of FIG. 47.

As another example, FIG. 47 is a top perspective view of the example drop-down diffuser 3702 including an example third blanking panel arrangement 4702. The third blanking panel arrangement 4702 of the illustrated example blocks a portion of the first fabric sheet 3710 and a portion of the second fabric sheet 3712. The third blanking panel arrangement 4702 enables air flow to be directed away from a particular direction. For example, the third blanking panel arrangement 4702 reduces (e.g., prevents) air from exiting a left side (as oriented in the drawing) of the drop-down diffuser 3702. Such a blanking panel arrangement may be advantageous when air flow is required in one direction, but not in another. For example, if the drop-down diffuser 3702 is installed in a laboratory, and is intended to provide fresh air to an area where air contaminants may be expected (e.g., a lab bench, a fume hood, etc.), one or more blanking panels can be installed to target the air flow exiting the drop-down diffuser 3702 toward this area. In the illustrated example of FIG. 47, for example, the drop-down diffuser 3702 provides targeted air flow to a right-side (as oriented in the drawing) of the drop-down diffuser 3702. FIG. 48 is a top view of the drop-down diffuser 3702 of FIG. 47, illustrating the third blanking panel arrangement 4702.

Figure 49:
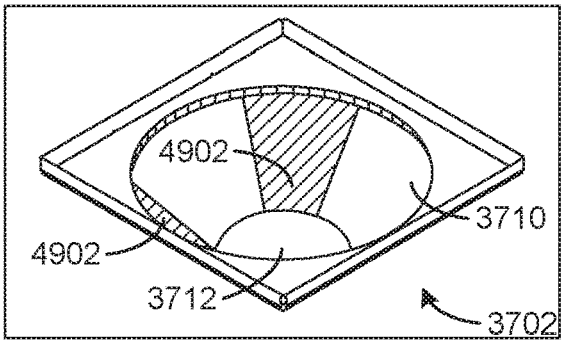
FIG. 49 is a view similar to FIG. 43 but showing the example drop-down diffuser utilizing an example fourth blanking panel arrangement.
Figure 50:
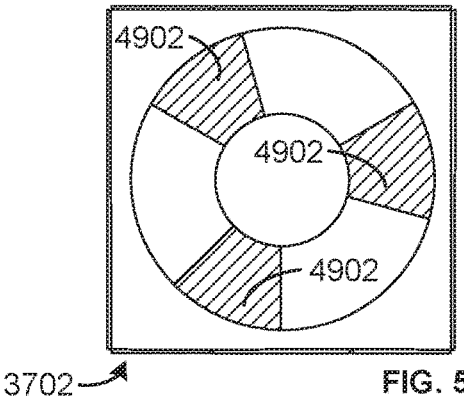
FIG. 50 is a top view of the drop-down diffuser of FIG. 49.

The example drop-down diffuser 3702 as depicted in FIG. 49 includes an example fourth blanking panel arrangement 4902. The fourth blanking panel arrangement 4902 blocks air flow through spaced apart portions of the first fabric sheet 3710, without blocking air flow through the second fabric sheet 3712. The blanking panels of the fourth blanking panel arrangement 4902 are evenly distributed around the first fabric sheet 3710, thus reducing air flow through the first fabric sheet 3710 while maintaining a balanced distribution of air flow around the drop-down diffuser 3702. FIG. 50 is a top view of the drop-down diffuser 3702 of FIG. 49, depicting the fourth blanking panel arrangement 4902.

While FIGS. 43-50 depict four possible blanking panel arrangements, drop-down diffusers disclosed herein may utilize blanking panels of any shape, size, material, and/or orientation. In some examples, the blanking panel arrangement may be adjusted at any time by removing the lower portion 3707 of the drop-down diffuser (e.g., by unzipping it from the upper portion 3708 of the drop-down diffuser 3702, in a reverse procedure relative to FIGS. 39-42) and adjusting positions of one or more blanking panels.

Figure 51:
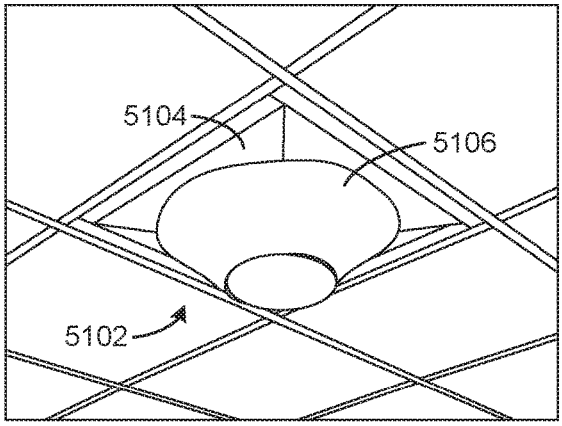
FIG. 51 is a bottom perspective view of another example drop-down diffuser.
Figure 52:
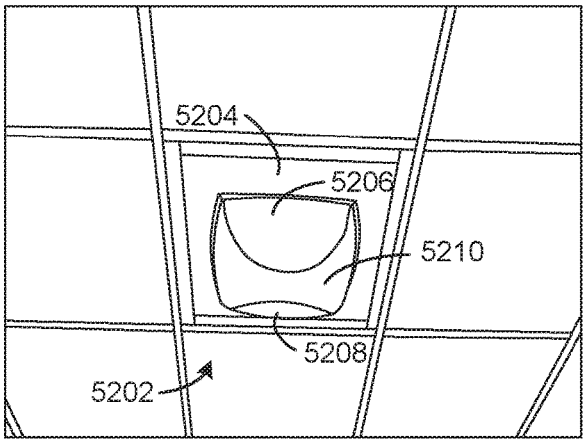
FIG. 52 is a bottom perspective view of another example drop-down diffuser.
Figure 53:
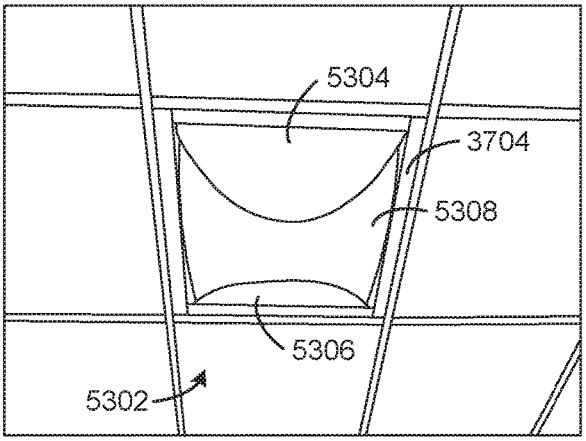
FIG. 53 is a bottom perspective view of another example drop-down diffuser.

Some example alternative geometries of drop-down diffusers are depicted in FIGS. 51-53. FIG. 51 is a bottom perspective view of another example drop-down diffuser 5102. In contrast to the example drop-down diffuser 3702 of FIG. 37, the example drop-down diffuser 5102 of FIG. 51 includes an example upper portion 5104 including multiple fabric segments. That is, the upper portion 5104 of the illustrated example of FIG. 51 includes seams extending between a connection with an example first fabric sheet 5106 and corners of the drop-down diffuser 5102. Another example drop-down diffuser 5202 is depicted in FIG. 52. The drop-down diffuser 5202 of the illustrated example includes an example upper portion 5204 having a rectangular opening for a lower portion of the drop-down diffuser 5202. The lower portion of the example drop-down diffuser 5202 includes an example first fabric sheet 5206, positioned opposite an example second fabric sheet 5208. The first fabric sheet 5206 and the second fabric sheet 5208 have a generally semicircular shape, with flat sides connected to opposing ends of the rectangular opening of the upper portion 5204. The lower portion of the drop-down diffuser 5202 of the illustrated example of FIG. 52 also includes an example third fabric sheet 5210 connected to the first fabric sheet 5206, the second fabric sheet 5208, and the upper portion 5204. In some examples, any combination of the first fabric sheet 5206, the second fabric sheet 5208, the third fabric sheet 5210 and/or the upper portion 5204 may be structured as a singular fabric sheet or structured as additional fabric sheets (e.g., further divided into more fabric sheets).

An additional example drop-down diffuser 5302 is illustrated in FIG. 53. The drop-down diffuser 5302 of the illustrated example does not include an upper portion, but includes an example first fabric sheet 5304, an example second fabric sheet 5306, and an example third fabric sheet 5308. The first fabric sheet 5304 and the second fabric sheet 5306 of the illustrated example have a generally semicircular shape, with the flat end of the semicircles aligned with the edges of the mounting pan 3704. The third fabric sheet 5308 of the illustrated example extends between the first fabric sheet 5304 and the second fabric sheet 5306 and between opposing edges of the mounting pan 3704. In some examples, one or more of the first fabric sheet 5304, the second fabric sheet 5306, and/or the third fabric sheet 5308 may be structured as a singular fabric sheet or structured as additional fabric sheets (e.g., further divided into more fabric sheets).

While example alternative geometries of drop-down diffusers are depicted in FIGS. 51-53, fabric sheets and/or panels may be arranged in numerous other geometries. For example, one or more fabric sheets can be used to create a drop-down diffuser in the shape of a sphere, a hemisphere, a pyramid, a cylinder, a cone, an ellipsoid, etc.

Returning to FIG. 38, the example drop-down diffuser 3702 includes example attachment edges 3808 to couple the drop-down diffuser 3702 to an example mounting pan lip 5406 (FIG. 54) of the mounting pan 3704. In the illustrated example, the attachment edges 3808 include plastic clips which can be stretched around the mounting pan lip 5406 to couple the drop-down diffuser 3702 to the mounting pan 3704. Similar attachment edges 3808 may be implemented on any of the other example diffusers disclosed herein. Further detail of the coupling of the attachment edges 3808 of the drop-down diffuser 3702 and the mounting pan lip 5406 of the mounting pan 3704 is illustrated and described in connection with FIGS. 54-56.

Figure 54:
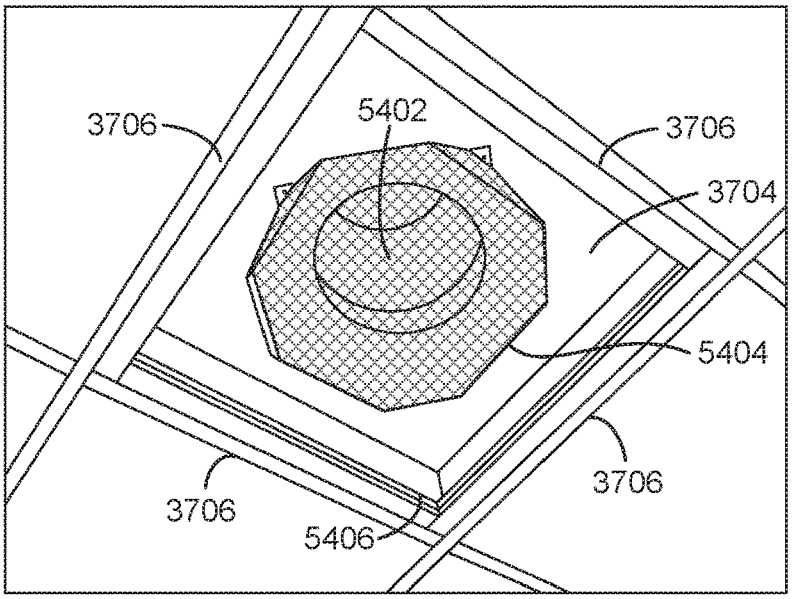
FIG. 54 is a top view of the mounting pan of FIG. 37 with the drop-down diffuser of FIG. 37 removed.
Figure 55:
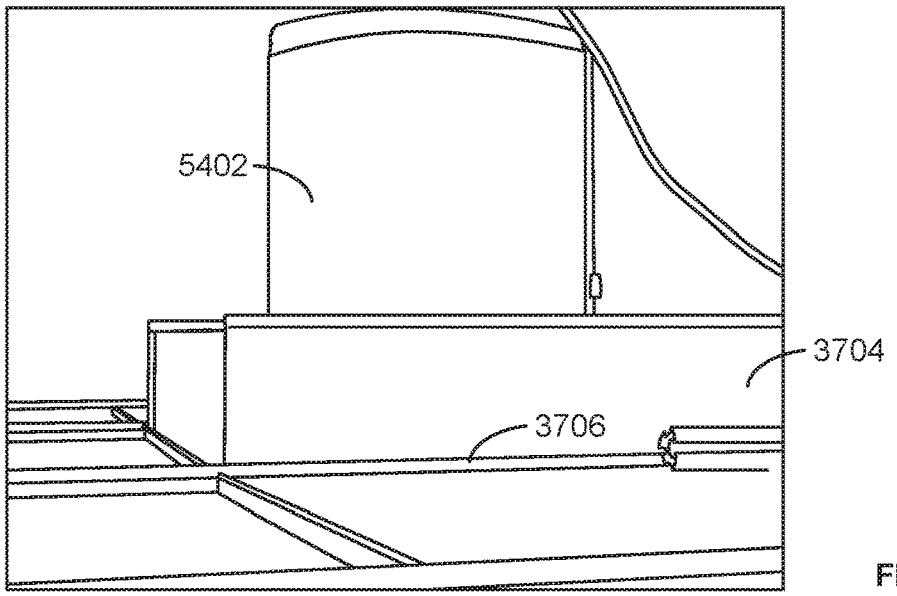
FIG. 55 is a side view of the mounting pan of FIG. 54 from above the ceiling.
Figure 56:
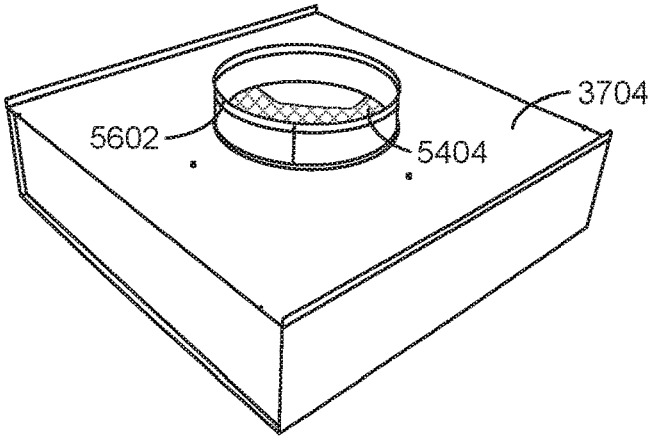
FIG. 56 is a top perspective view of the mounting pan of FIG. 54, before installation in the ceiling.

FIG. 54 is a bottom view of the mounting pan 3704 of FIG. 37 with the drop-down diffuser 3702 of FIG. 37 removed. The mounting pan 3704 extends above the ceiling, and is connected to one or more of the ceiling grid components 3706. The mounting pan extends upward to provide a chamber which receives air from an example supply air duct 5402. A side view from above the ceiling of the ceiling grid components 3706 and the supply air duct 5402 is illustrated in FIG. 55. In some examples, the supply air duct 5402 is the supply air duct 14, and/or any other structure to supply air to the drop-down diffuser 3702. The supply air duct 5402 is aligned with an example air supply inlet collar 5602 illustrated in FIG. 56 to position the supply air duct 5402 above the mounting pan 3704. Air exiting the supply air duct 5402 encounters an example perforated panel 5404, which serves to regulate (e.g., evenly distribute) the air supply as it enters the drop-down diffuser 3702. In some examples, the perforated panel 5404 can be any type of air straightener to straighten the flow of air entering the chamber and the drop-down diffuser 3702. The perforated panel 5404 of the illustrated example is a honeycomb perforated panel, and is connected to the mounting pan 3704 at a back surface (e.g., the surface aligned with the air supply inlet collar 5602) of the mounting pan 3704.

The mounting pan 3704 includes an example mounting pan lip 5406, which can be used to attach the drop-down diffuser 3702. The mounting pan lip 5406 extends upward (e.g. into the chamber of the mounting pan 3704). For example, a surface of the drop-down diffuser 3702 (e.g., a clip on the perimeter of the drop-down diffuser 3702) can be removably connected to the mounting pan lip 5406 to attach the drop-down diffuser 3702 to the mounting pan 3704.

Figure 57:
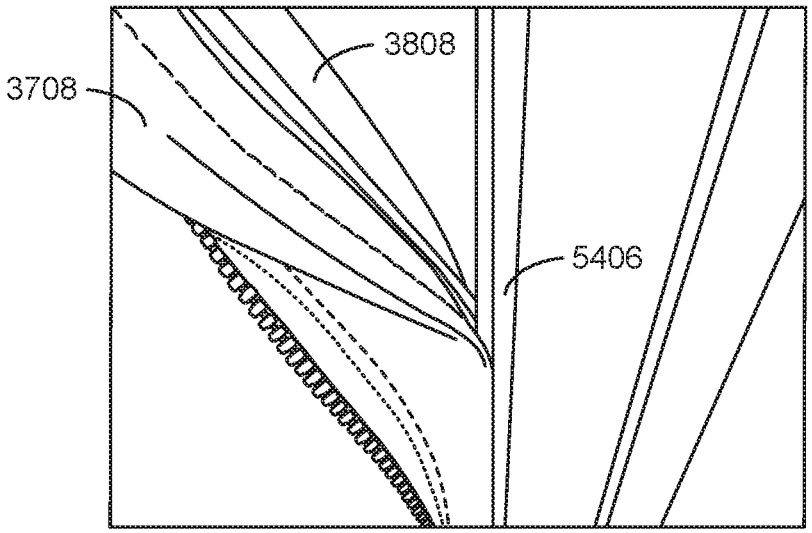
FIG. 57 illustrates an edge of the drop-down diffuser of FIG. 37 partially engaged with the mounting pan of FIG. 54.

FIG. 57 illustrates one of attachment edges 3808 of the drop-down diffuser 3702 of FIG. 39 partially engaged with the mounting pan lip 5406 of the mounting pan 3704. An operator (e.g., an installer) can install the drop-down diffuser 3702 in the mounting pan 3704 by holding onto the upper portion 3708 and/or the attachment edges 3808 and placing the attachment edges 3808 over the mounting pan lip 5406. In some examples, the operator must physically stretch a clip (e.g., the clip 5802) and place it over the mounting pan lip 5406 to mount the drop-down diffuser 3702.

Figure 58:
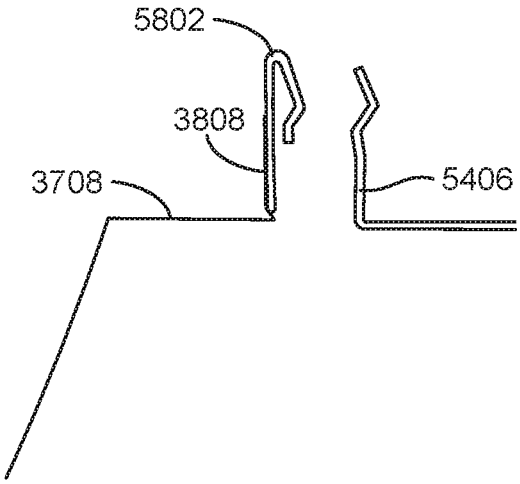
FIG. 58 is a cross-sectional view of example attachment edges of the drop-down diffuser and an example mounting pan lip structured to connect the fabric drop-down diffuser and the mounting pan, with the drop-down diffuser and the mounting pan disengaged.
Figure 59:
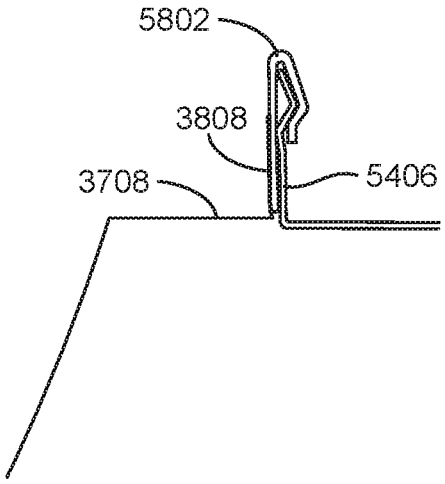
FIG. 59 is similar to the cross-sectional view of FIG. 58, but with the drop-down diffuser and the mounting pan engaged.

One example means of attaching the drop-down diffuser 3702 to the mounting pan lip 5406 of the mounting pan 3704 is illustrated in FIGS. 58-59. FIG. 58 is a cross-sectional view of one of the attachment edges 3808 of the drop-down diffuser 3702 and the mounting pan lip 5406 structured to connect the fabric drop-down diffuser 3702 and the mounting pan 3704. In FIG. 58, the drop-down diffuser 3702 and the mounting pan 3704 are disengaged. The attachment edges 3808 include an example clip 5802 (e.g., a plastic clip, a metal clip, etc.) to extend over the mounting pan lip 5406 to secure the drop-down diffuser 3702 to the mounting pan 3704. In the illustrated example, the clip 5802 has complementary geometry to the mounting pan lip 5406. FIG. 59 illustrates the drop-down diffuser 3702 and the mounting pan 3704 engaged via the clip 5802. In FIG. 59, the clip 5802 extends over and around the mounting pan lip 5406, thus securing the drop-down diffuser 3702 to the mounting pan 3704. For example, if a force were applied on the drop-down diffuser 3702 in the downward direction (away from the ceiling), the clip 5802 would interfere with the mounting pan lip 5406 and prevent removal of the drop-down diffuser 3702. In some examples, the clip 5802 and the mounting pan lip 5406 may have any other geometry that enables attachment of the mounting pan 3704 and the drop-down diffuser 3702.

While one example attachment method to couple the drop-down diffuser 3702 to the mounting pan 3704 is illustrated and described in association with FIGS. 58-59, any number of techniques may be utilized instead. For example, a hook-and-loop attachment mechanism, a zipper, an adhesive, another clip design, an integral manufacturing process (e.g., directly manufacturing the drop-down diffuser 3702 to be connected with the mounting pan 3704), and/or any other attachment technique may be employed to mount the drop-down diffuser 3702 to the mounting pan 3704.

Figure 60:
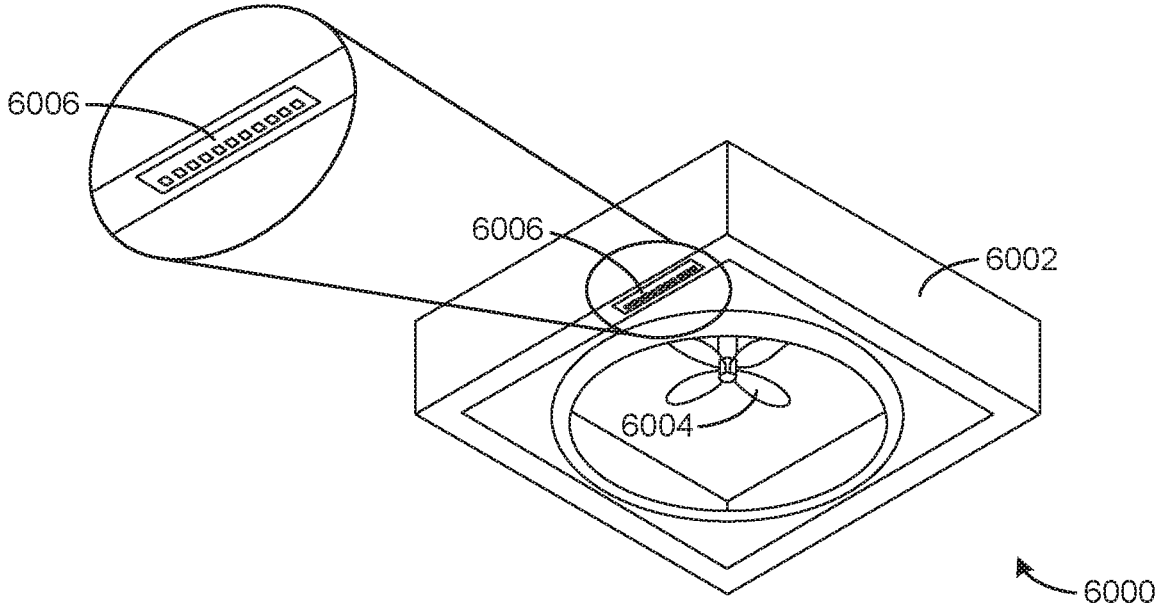
FIG. 60 is a bottom perspective view of an example drop-down diffuser system including an example air flow indicator, with the drop-down diffuser removed to illustrate an example air flow sensing system mounted in an example mounting pan.

Some example drop-down diffuser systems disclosed herein monitor a rate of air flow through the drop-down diffuser, and display air flow information. FIG. 60 is a bottom perspective view of an example drop-down diffuser system 6000 having an example air flow indicator 6006, with the drop-down diffuser removed. In the view of FIG. 60, an internal chamber of the mounting pan 6002 is visible. Inside the mounting pan 6002 is an example fan 6004 (e.g., of the air flow sensing system), which both evenly distributes air flow and rotates to generate a signal indicating air flow through the mounting pan 6002. For example, the fan 6004 may be connected to a turbine and/or motor, which generates an electric current proportional to the air flow through the mounting pan 6002. The turbine and/or motor may then provide the electric current and/or voltage to the air flow indicator 6006 to output an indication (e.g., a light, a sound, etc.) corresponding to the air flow through the mounting pan 6002. In some examples, in addition to or alternatively to the fan 6004 and air flow indicator 6006, an air flow sensor (e.g., an anemometer), pressure sensor, and/or any other sensor are included in the mounting pan 6002 to sense air flow through the mounting pan 6002.

The air flow indicator 6006 of the illustrated example includes a plurality of lights (e.g., LED lights) arranged from a "low" label to a "high" label. When a relatively small amount of current (e.g., relative a current corresponding to an overall air flow rate capacity of the system) is generated based on the air flow through the mounting pan 6002, one or more lights of the air flow indicator 6006 near the "low" label may be turned on. When a relatively high amount of current (e.g., relative to the overall air flow capacity) is generated based on the air flow, additional lights of the air flow indicator 6006 may be turned on, such that a plurality of lights from the "low" label toward the "high" label are turned on sequentially based on the current value. The air flow indicator 6006 is mounted on an edge of the mounting pan 6002, such that when the mounting pan 6002 is installed in a ceiling, the edge including the air flow indicator 6006 is oriented downward and visible below the drop-down diffuser system. In some examples, the air flow indicator 6006 is located on another part of the mounting pan 6002 and/or another component associated with the drop-down diffuser assembly. For example, in FIG. 61, example indicator lights 6102 are radially mounted to a collar 6103 adjacent an upper portion of the example drop-down diffuser 6104.

Figure 61:
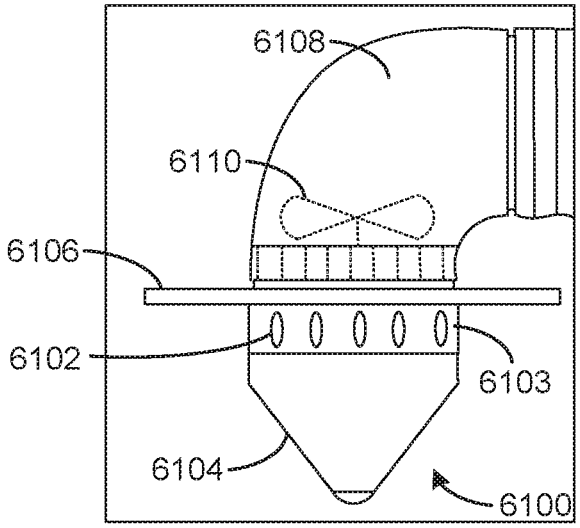
FIG. 61 is a side view of an example system including another example drop-down diffuser with indicator lights radially mounted adjacent the drop-down diffuser.

The indicator lights 6102 of the illustrated example of FIG. 61 are mounted on a ring-shaped component which is connected to the drop-down diffuser 6104 as well as an example ceiling mount 6106. The ceiling mount 6106 of the illustrated example is an adapter which receives a portion of the drop-down diffuser 6104 and/or the ring-shaped component connected to the drop-down diffuser 6104 on one side (e.g., the bottom side in the orientation of FIG. 61), and connects to an example supply air inlet 6108 on the opposite side (e.g., the top side in the orientation of FIG. 61). The drop-down diffuser system 6100 includes an example fan 6110 that distributes air evenly in the drop-down diffuser 6104 and generates a current (e.g., via a brushless motor) that can be provided to the indicator lights 6102 to display an indication of the rate of air flow exiting the drop-down diffuser 6104.

In some examples, a number of the indicator lights 6102 which are turned on is used to indicate the rate of airflow (e.g., a higher rate of airflow results in more of the indicator lights 6102 turning on). In some examples, a color of the indicator lights 6102 is used to indicate a rate of flow (e.g., red for no flow, yellow for little flow, green for high flow, etc.).

In some examples, current and/or voltage data corresponding to an air flow rate is communicated to a system (e.g., a central HVAC control system, a mobile device, etc.) separate from the drop-down diffuser system. The air flow indicator 6006 may be any type of indicator (e.g., a numerical indicator providing air flow values, multiple colored lights indicating a rate of air flow, etc.) to inform a user of a rate of air flow through the drop-down diffuser system.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A drop-down diffuser comprising: an upper portion, including a third fabric sheet, to be removably connected to a mounting pan, the mounting pan to be disposed above a ceiling; a lower portion to be removably connected to the upper portion, the lower portion to include a first fabric sheet and a second fabric sheet, the first fabric sheet to extend away from the ceiling at a location adjacent a supply air inlet, the supply air inlet to provide a flow of air toward the first fabric sheet; and a blanking sheet to restrict air flow through the first fabric sheet, the blanking sheet to be disposed on an interior surface of the first fabric sheet, the blanking sheet having a facing surface to face the interior surface, the facing surface to be aligned and in contact with the interior surface, the blanking sheet removably coupled to at least one of the first fabric sheet, the second fabric sheet, or the third fabric sheet, the blanking sheet having a lower permeability than the first fabric sheet.

2. The drop-down diffuser of claim 1, wherein the upper portion includes an attachment edge, the attachment edge including a first clip to extend over a lip of the mounting pan to couple the drop-down diffuser to the mounting pan.

3. The drop-down diffuser of claim 2, wherein the mounting pan is to attach to a ceiling grid of the ceiling, the mounting pan to connect to the supply air inlet.

4. The drop-down diffuser of claim 1, wherein the upper portion includes an opening, the first fabric sheet to removably connect to the upper portion around a perimeter of the opening.

5. The drop-down diffuser of claim 4, wherein the upper portion is to removably connect to the first fabric sheet by at least one of a zipper or a hook-and-loop connection.

6. The drop-down diffuser of claim 5, further including a connection cover to selectively cover the at least one of the zipper or the hook-and-loop connection when the upper portion is connected to the first fabric sheet.

7. The drop-down diffuser of claim 1, wherein the first fabric sheet and the second fabric sheet have different permeabilities.

8. The drop-down diffuser of claim 1, wherein the blanking sheet is to restrict the air flow through an entire area of the second fabric sheet.

9. The drop-down diffuser of claim 1, wherein the blanking sheet is a first blanking sheet, the drop-down diffuser further including a second blanking sheet.

10. The drop-down diffuser of claim 9, wherein the first and second blanking sheets are to restrict the air flow through different spaced apart areas of the second fabric sheet.

11. The drop-down diffuser of claim 9, wherein the first and second blanking sheets are to restrict the air flow through different spaced apart areas of the first fabric sheet.

12. The drop-down diffuser of claim 9, wherein the first blanking sheet is to restrict the air flow through a first area of the first fabric sheet and the second blanking sheet is to restrict the air flow through a second area of the second fabric sheet.

13. The drop-down diffuser of claim 1, wherein the blanking sheet is to removably connect to the first fabric sheet by a hook-and-loop connection.

14. The drop-down diffuser of claim 1, further including a flow rate indicator to provide a visual indication of a flow rate of air moving through the drop-down diffuser based on a signal from an air flow sensor.

15. A drop-down diffuser comprising: an upper portion, including a third fabric sheet, to be removably connected to a mounting pan, the mounting pan to be disposed above a ceiling; a lower portion to be removably connected to the upper portion, the lower portion to extend away from the ceiling; and a blanking sheet to be positioned against the lower portion so as to cover an area of a surface of the lower portion, the blanking sheet having a lower permeability than a material of the lower portion to reduce air flow through the covered area of the lower portion relative to other areas of the surface of the lower portion.

16. The drop-down diffuser of claim 15, wherein the mounting pan includes a perforated panel disposed between a supply air inlet and the upper portion, the perforated panel to regulate distribution of air flow entering the drop-down diffuser.

17. The drop-down diffuser of claim 15, wherein the blanking sheet is to be obscured from view below the ceiling.

18. A drop-down diffuser comprising: an upper portion, including a third fabric sheet, to be removably coupled to a mounting pan at a perimeter of the upper portion, the mounting pan disposed above a ceiling, the upper portion including a circular opening within and spaced apart from the perimeter of the upper portion; a lower portion including a first fabric sheet and a second fabric sheet, the first fabric sheet to be connected to the upper portion at the circular opening such that the lower portion is spaced apart from and inside the perimeter of the upper portion, the second fabric sheet to be connected to the first fabric sheet, the second fabric sheet being circular, the first fabric sheet to extend from the circular opening to a circumference of the second fabric sheet, the circumference of the second fabric sheet being less than a circumference of the circular opening; and a blanking sheet removably coupled to at least one of the upper portion, the first fabric sheet, or the second fabric sheet, the blanking sheet having a lower permeability than the at least one of the upper portion, the first fabric sheet, or the second fabric sheet.

19. The drop-down diffuser of claim 18, further including:

an air flow sensor; and a flow rate indicator to provide a visual indication of a flow rate of air moving through the drop-down diffuser based on a signal from the air flow sensor.

20. The drop-down diffuser of claim 19, wherein the flow rate indicator includes a series of lights disposed radially around a collar adjacent the upper portion.

21. The drop-down diffuser of claim 19, wherein the flow rate indicator includes a series of lights disposed on a surface of the mounting pan that is visible below the ceiling.

* * * * *